US006068549A

United States Patent [19]

Jackson

[11] Patent Number: 6,068,549

[45] Date of Patent: May 30, 2000

[54] STRUCTURE AND METHOD FOR THREE CHAMBER CMP POLISHING HEAD

[75] Inventor: Paul Jackson, Paradise Valley, Ariz.

[73] Assignee: Mitsubishi Materials Corporation, Tokyo, Japan

[21] Appl. No.: 09/363,980

[22] Filed: Jul. 28, 1999

Related U.S. Application Data

[60] Provisional application No. 60/141,352, Jun. 28, 1999.

[51] Int. Cl.[7] ..... B24B 5/00; B24B 47/02

[52] U.S. Cl. ..... 451/398; 451/397; 451/288

[58] Field of Search ..... 451/41, 28, 63, 451/288, 289, 388, 397, 398, 400, 364

[56] References Cited

U.S. PATENT DOCUMENTS

| | | | |
|---|---|---|---|
| 5,584,751 | 12/1996 | Kobayashi et al. | 451/398 |
| 5,681,215 | 10/1997 | Sherwood et al. | 451/288 |
| 5,857,899 | 1/1999 | Volodarsky et al. | 451/398 |

*Primary Examiner*—Derris Holt Banks
*Attorney, Agent, or Firm*—Flehr Hohbach Test Albritton & Herbert

[57] ABSTRACT

The invention provides a polishing machine and a three-chambered polishing head structure and method that improves the polishing uniformity of a substrate across the entire surface of the substrate, particularly near the edge of the substrate that is particularly beneficial to improve the uniformity of semiconductor wafers during Chemical Mechanical Polishing (CMP). In one aspect, the invention provides a method of controlling the polishing pressure over annular regions of the substrate, such as a wafer, in a semiconductor wafer polishing machine. The method includes controlling a first pressure exerted on the wafer against a polishing pad to affect the material removed from the wafer; controlling a second pressure exerted on a retaining ring, disposed concentric with the wafer, directly against the polishing pad, to affect the manner in which the polishing pad contacts the wafer at a peripheral edge of the wafer; and controlling a third pressure exerted within a predetermined annular region proximate an inner annular region of the retaining ring and an outer annular edge of the wafer to affect a change to the first and second pressure only proximate the annular region. Each of the first, second, and third pressures being independently controllable of the other pressures.

9 Claims, 26 Drawing Sheets

2X-ø.196± .002 THRU
C'BORE ø.250 X .030 DP.
EQ. SPACED ON
ø1.500 ±.002 B.C.

2X-M3X.5
2X-0.35
2X-RO.06

0.125
SEE FIG. 24D
SEE FIG. 24E
0.313
0.700
0.125
ø5.69
ø6.92
ø7.170
0.194
ø7.420 O.D.

14X-ø.144 +.006 -.000 THRU BOTH WALLS EQ. SPACED ON ø6.160 BOLT CIRCLE
C
B
B
3X-120°
6X-RO.03
C
3X-1.38
3X-0.69
3X-BLEND WITH ø7.170

SEE FIG. 24F (3X-BLEND WITH ø7.170)
(ø.144)
RO.02
2X-RO.06
2X-RO.06

SEE FIG. 26E
SEE FIG. 26D
SEE FIG. 26C
SEE FIG. 26B
SEE FIG. 26F
SEE FIG. 26G
.03 X 45° CHAMFER
.062 X .015 DEEP GRIND RELIEF
3X-ø.159 THRU INTO HOLE
2X-20°
2X-.13R
ø1.920
ø1.550
ø1.123 +.000 -.001
ø1.510
ø1.5738 +.0000 -.0006
ø1.5744 +.0000 -.0004
ø1.400
ø1.297
ø1.377 +.000 -.001
ø1.250
ø1.1807 +.0000 -.0004
3X-ø1.091
ø1.053
ø.9839 +.0000 -.0004
ø1.124±.001
ø.925
0.047±.001
0.175
0.000
0.110
(8.625)
(8.205)
(7.465)
(ø1.510)
(ø1.5738)
(6.205)
(6.015)
(5.935)
(5.745)
(ø1.400)
(5.220)
(5.120)
(5.057)
(ø1.374)
(ø1.5744)
(3.479)
(3.416)
(ø1.1807)
(1.831)
0.080
0.040
0.030
ø.243 +.000 -.002
ø.341 +.000 -.002
0.120
0.095 +.005 -.000
20°
15°
.06

STRUCTURE AND METHOD FOR THREE CHAMBER CMP POLISHING HEAD

This application claims priority to U.S. Ser. No. 60/141,352 filed Jun. 28, 1999.

FIELD OF THE INVENTION

The invention relates to chemical mechanical planarization and polishing of substrates including silicon surfaces, metal films, oxide films, and other types of films on a surface, more particularly to a polishing head including a substrate carrier assembly with substrate retaining ring, and most particularly to a polishing head and method for silicon or glass substrate polishing and chemical mechanical planarization of various oxides, metals, or other deposited materials on the surface of such substrates.

BACKGROUND

Sub-micron integrated circuits (ICs) require that the device surfaced be planarized at their metal inter-connect steps. Chemical mechanical polishing (CMP) is the technology of choice for planarizing wafer surfaces. The IC transistor packaging density has been doubled about every 18 months, according to the so called "Moore's Law".

There are two methods by which to increase the packing density of transistors on a chip. The first method is to increase the device or die size. This is not always the best method, however, because as the die size increases, the die yield per wafer decreases. Due to the fact that the defect density per unit area is the constraint factor, the amount of defect-free dies er area decreases as the die size increases. Not only will the yield be lower, but the number of die that can be stepped (printed) on the wafer will also decrease. The second method is to shrink the size of the transistor feature. Smaller transistors mean a higher switching speed. By decreasing the transistor size, more transistors and more logic functions or memory bits can be packed onto the same device area without increasing die size. The shrinking of the feature size is what has driven technology to deliver the results that were predicted by Dr. Moore of Intel.

Sub-half micron technology has been rapidly evolved into sub-quarter micron technology in the past three years alone. The number of transistors being fabricated on each chip has increased enormously—from hundreds of thousands transistors per chip three years ago to more than five million transistors per chip today, to hundreds of millions of transistors per chip by the year of 2006. By that time, the amount of inter-connect wiring will have increased from hundreds of meters in length today to more than 20 km. The current solution to the challenge is to build layers upon layers of inter-connect wiring with insulating (dielectric) thin films in between. The wiring is also connectable vertically through vies; to achieve all electrical paths as required by the integrated circuit functions.

A new technology which uses inlaid metal lines embedded in insulating dielectric layers was invented by IBM engineers in the late 80's to meet the I.C. inter-connect needs. The inlaid metal line structure allows for metal wiring connections to be made on the same plane as well as on an up and down direction through plasma etched trenches and vies in the dielectric layer. Theoretically, these connection planes can be built with as many layers on top of each other as desired, as long as each layer is well planarized with CMP process. The ultimate limit of the interconnect is formed by the connection resistance(R) and the proximity capacitance (C). The so-called RC constant limits the signal-to-noise ratio and causes the power consumption to increase, rendering the chop non-functional. According to the SIA road map forecasted for the year 2006, the number transistors to be integrated on a chip will be as many as one billion, and the number of layers of interconnect will increase from five layers to about nine layers.

To meet the new inter-connect technology challenge, the CMP process and CMP tool performance would desirably be improved to achieve the following three goals.

First, wafer edge exclusion due to over- and under-polishing must be reduced from 6 mm to less than 3 mm. It is necessary to increase the area of electrically good dies than can be produced around the peripheral area of the wafer. Due to the die size increase from 10 mm per side today to 20 mm per side, as well as the wafer size increase from 200 mm to 300 mm before the year 2006, the potential for electrically good dies will be more than double if the 2 mm edge exclusion CMP performance can be achieved.

Second, polishing non-uniformity would desirably be improved from 5% (1 sigma) to less than 3%. The wafer carrier design must be able to apply uniform and appropriate force across the wafer during polishing.

Third, CMP would desirably be capable of polishing metallized wafers under compressive or tensile stress. Commonly used metals for inter-connect are aluminum and copper alloy, titanium, titanium nitride, tungsten, tantalum, and copper. The metallized wafers are often under stress due to the process condition, hardness of the metal, or thickness of the metal. The stressed wafers can bow inward (compressive stress) or outward (tensile stress) and as a result can cause a serious non-uniformity problem during polishing, as metal line dishing and oxide or dielectric layer erosion occur. In both cases, the consequence is a yield loss or decrease in the number of good dies per wafer. The new improved floating head and floating retaining ring design will allow for polishing down forces to be distributed optimally across the entire wafer, the wafer edge, and onto the polishing pad prior to contacting the wafer edge, in order to achieve a uniformly planarized surface across the edge of the wafer and its interior.

Integrated circuits are conventionally formed on substrates, particularly silicon wafers, by the sequential deposition of one or more layers, which layers may be conductive, insulative, or semiconductive. These structures are sometimes referred to as the multi-layer metal structures (MIM's) and are important relative to achieving closepacking of circuit elements on the chip with the ever decreasing design rules.

Flat panel displays such as those used in notebook computers, personal data assistants (PDAs), cellular telephones, and other electronic devices, may typically deposit one or mor layers on a glass or other transparent substrate to form the display elements such as active or passive LCD circuitry. After each layer is deposited, the layer is etched to remove material from selected regions to create circuitry features. As a series of layers are deposited and etched, the outer or topmost surface of the substrate becomes successively less planar because the distance between the outer surface and the underlying substrate is greatest in regions of the substrate where the least etching has occurred, and the distance between the outer surface and the underlying substrate is least in regions where the greatest etching has occurred. Even for a single layer, the non-planar surface takes on an uneven profile of peaks and valleys. With a plurality of patterned layers, the difference in the height between the peaks and valleys becomes much more severe, and may typically vary by several microns.

A non-planar upper surface is problematic respective of surface photolithography used to pattern the surface, and respective of layers that may fracture if deposited on a surface having excessive height variation. Therefore, there is a need to planarize the substrate surface periodically to provide a planar layer surface. Planarization removes the non-planar outer surface to form a relatively flat, smooth surface and involves polishing away the conductive, semiconductive, or insulative material. Following planarization, additional layers may be deposited on the exposed outer surface to form additional structures including interconnect lines between structures, or the upper layer may be etched to form vias to structures beneath the exposed surface. Polishing generally and chemical mechanical polishing (CMP) more particularly are known methods for surface planarization.

The polishing process is designed to achieve a particular surface finish (roughness or smoothness) and a flatness (freedom from large scale typography). Failure to provide minimum finish and flatness may result in defective substrates, which in tern may result in defective integrated circuits.

During CMP, a substrate such as a semiconductor wafer, is typically mounted with the surface to be polished exposed, on a wafer carrier which is part of or attached to a polishing head. The mounted substrate is then placed against a rotating polishing pad disposed on a base portion of the polishing machine. The polishing pad is typically oriented such that it's flat polishing surface is horizontal to provide for even distribution of polishing slurry and interaction with the substrate face in parallel opposition to the pad. Horizontal orientation of the pad surface (the pad surface normal is vertical) is also desirable as it permits the wafer to contact the pad at least partially under the influence of gravity, and at the very least interact in such manner that the gravitational force is not unevenly applied between the wafer and the polishing pad. In addition to the pad rotation, the carrier head may rotate to provide additional motion between the substrate and polishing pad surface. The polishing slurry, typically including an abrasive suspended in a liquid and for CMP at least one chemically-reactive agent, may be applied to the polishing pad to provide an abrasive polishing mixture, and for CMP an abrasive and chemically reactive mixture at the pad substrate interface. Various polishing pads, polishing slurries, and reactive mixtures are known in the art, and which is combination allow particular finish and flatness characteristics to be achieved. Relative speed between the polishing pad and the substrate, total polishing time, and the pressure applied during polishing, in addition to other factors influence the surface flatness and finish, as well as the uniformity. It is also desirable that the polishing of successive substrates, or where a multiple head polisher is used, all substrates polished during any particular polishing operation are planarized to the same extent, including remove of substantially the same amount of material and providing the same flatness and finish. CMP and wafer polishing generally are well known in the art and not described in further detail here.

The condition of the polishing pad may also affect polishing results, particularly the uniformity and stability of the polishing operation over the course of a single polishing run, and more especially, the uniformity of polishing during successive polishing operations. Typically, the polishing pad may become glazed during one or more polishing operations as the result of heat, pressure, and slurry or substrate clogging. The effect is to lessen the abrasive characteristic of the pad over time as peaks of the pad are compressed or abraded and pits or voids within the pad fill with polishing debris. In order to counter these effects, the polishing pad surface must be conditioned in order to restore the desired abrasive state of the pad. Such conditioning may typically be carried out by a separate operation performed periodically on the pad to maintain its abrasive state. This also assists in maintaining stable operation during which a predetermined duration of polishing will remove a predetermined amount of material from the substrate, achieve a predetermined flatness and finish, and otherwise produce substrates that have sufficiently identical characteristics so that the integrated circuits fabricated from the substrates are substantially identical. For LCD display screens, the need for uniform characteristics may be even more pronounced, because unlike wafers which are cut into individual dies, a display screen which may be several inches across, will be totally unusable if even a small area is unusable due to defects.

An insert, as has conventionally been used is an inexpensive pad that is bonded to the wafer sub-carrier and is between the backside of the wafer and the carrier surface which may be a metal or ceramic surface. Variations in the mechanical characteristics of the insert typically may cause variations in the polishing results of CMP. Edge effects in the vicinity of the wafer periphery or edge may either degrade or alternately improve wafer surface characteristics depending on polisher head design. For example, on some polishing heads incorporating retaining rings, degrading effects may be lessened by providing an appropriate retaining ring structure to migrate the edge effects away from the wafer edge.

In U.S. Pat. No. 5,205,082 there is described a flexible diaphragm mounting of the sub-carrier having numerous advantages over earlier structures and methods, and U.S. Pat. No. 5,584,751 provides for some control of the down force on the retaining ring through the use of a flexible bladder; however, neither these patents describe structure for direct independent control of the pressure exerted at the interface of the wafer and retaining ring, or any sort of differential pressure to modify the edge polishing or planarization effects.

In view of the foregoing, there is a need for a chemical mechanical polishing apparatus which optimizes polishing throughput, flatness, and finish, while minimizing the risk of contamination or destruction of any substrate.

In view of the above, there remains a need for a polishing head that provides a substantially uniform pressure across the substrate surface being polished, that maintains the substrate substantially parallel to the polishing pad during the polishing operation, that maintains the substrate within the carrier portion of the polishing head without inducing undesirable polishing anomalies at the periphery of the substrate, and that desirably conditions the pad during the polishing operation.

The inventive structure and method incorporate numerous design details and innovative elements, some of which are summarized below. The inventive structures, methods, and elements are described in the detailed description.

SUMMARY

The invention provides a polishing machine and a three-chambered polishing head structure and method that improves the polishing uniformity of a substrate across the entire surface of the substrate, particularly near the edge of the substrate that is particularly beneficial to improve the uniformity of semiconductor wafers during Chemical Mechanical Polishing (CMP). In one aspect, the invention provides a method of controlling the polishing pressure over annular regions of the substrate, such as a wafer, in a semiconductor wafer polishing machine. The method includes controlling a first pressure exerted on the wafer against a polishing pad to affect the material removed from the wafer; controlling a second pressure exerted on a retaining ring, disposed concentric with the wafer, directly against the polishing pad, to affect the manner in which the polishing pad contacts the wafer at a peripheral edge of the wafer; and controlling a third pressure exerted within a predetermined annular region proximate an inner annular region of the retaining ring and an outer annular edge of the wafer to affect a change to the first and second pressure only proximate the annular region. Each of the first, second, and third pressures being independently controllable of the other pressures.

In another aspect, the inventive structure provides a three-chambered polishing head for polishing a substrate that includes a rotatable sub-carrier having a circular shape and an outer diameter for holding the substrate on a substrate mounting surface thereof during a polishing operation; a rotatable retaining ring having an inner diameter disposed concentric with the sub-carrier and extending beyond the substrate mounting surface during the polishing operation; a housing at least partially surrounding the sub-carrier and the retaining ring; a first diaphragm coupling each of the retaining ring the sub-carrier and the housing at a first location while permitting predetermined relative movement between the retaining ring, the sub-carrier, and the housing; a second diaphragm coupling the retaining ring and the sub-carrier to the housing at a second location while permitting predetermined relative movement between the retaining ring and the sub-carrier. The subcarrier, a first portion of the housing, and the first and second diaphragms defining a first pressure chamber; the sub-carrier, a second portion of the housing, and the first and second diaphragms defining a second pressure chamber. A member coupling the first diaphragm and the second diaphragm and defining an annular shaped third pressure chamber proximate the sub-carrier outer diameter and the retaining ring inner diameter, is also provided. The first chamber, the second chamber, and the third chamber being pressure isolated from each other and each being coupled to a pressurized fluid source so that the pressure in each of the first, second, and third chambers is separately controllable.

In yet another aspect, the inventive structure and method provide polishing head for polishing a substrate which includes a subcarrier having a circular shape and an outer diameter for holding the substrate during processing; a retainer ring having a circular shape and an inner diameter disposed concentric with the subcarrier; and an annular region being defined as a predetermined distance on either side of an interface between the subcarrier and the retaining ring. A first chamber disposed proximate the subcarrier to apply a first pressure to the subcarrier and hence to the substrate against a polishing pad during polishing; a second chamber disposed proximate the retaining ring to apply a second pressure to the retaining ring against the polishing pad during the polishing; and a third chamber disposed proximate the annular region to apply a third pressure to the region proximate the interface between the retaining ring and the subcarrier to influence the polishing of an annular peripheral region of the.

BRIEF DESCRIPTION OF THE DRAWINGS

Additional objects and features of the invention will be more readily apparent from the following detailed description and appended claims when taken in conjunction with the drawings, in which:

FIGS. 6–28 are diagrammatic illustrations showing other features and details of a particular preferred embodiment of the invention, in which:

FIG. 6 is a diagrammatic illustration of an exemplary subcarrier for a 200 mm diameter wafer polishing head.

FIG. 7 is a diagrammatic illustration of an exemplary subcarrier gasket.

FIG. 8 is a diagrammatic illustration of an exemplary ring.

FIG. 9 is a diagrammatic illustration of an exemplary adapter.

FIG. 10 is a diagrammatic illustration of an exemplary lower housing.

FIG. 11 is a diagrammatic illustration of an exemplary primary diaphragm.

FIG. 12 is a diagrammatic illustration of an exemplary inner flanged ring.

FIG. 13 is a diagrammatic illustration of an exemplary outer flanged ring.

FIG. 14 is a diagrammatic illustration of an exemplary locking ring.

FIG. 15 is a diagrammatic illustration of an exemplary secondary diaphragm.

FIG. 16 is a diagrammatic illustration of an exemplary inner stop ring.

FIG. 17 is a diagrammatic illustration of an exemplary outer stop ring.

FIG. 18 is a diagrammatic illustration of an exemplary housing seal ring.

FIG. 19 is a diagrammatic illustration of an exemplary mounting adapter.

FIG. 20 is a diagrammatic illustration of an exemplary upper housing.

FIG. 21 is a diagrammatic illustration of an exemplary retaining ring.

FIG. 22 is a diagrammatic illustration of an exemplary film insert.

FIG. 23 is a diagrammatic illustration of an exemplary head-plate adapter.

FIG. 24 is a diagrammatic illustration of an exemplary inner flanged ring.

FIG. 25 is a diagrammatic illustration of an exemplary spindle shaft.

FIG. 26 is a diagrammatic illustration of an exemplary cross sectional view of spindle shaft and portions of rotary union conduits.

FIG. 27 is a diagrammatic illustration of an exemplary turret drive sprocket.

FIG. 28 is a diagrammatic illustration of an exemplary spindle key.

DESCRIPTION OF SPECIFIC EMBODIMENTS

The inventive structure and method are now described in the context of specific exemplary embodiments illustrated in the figures.

Figure 1:
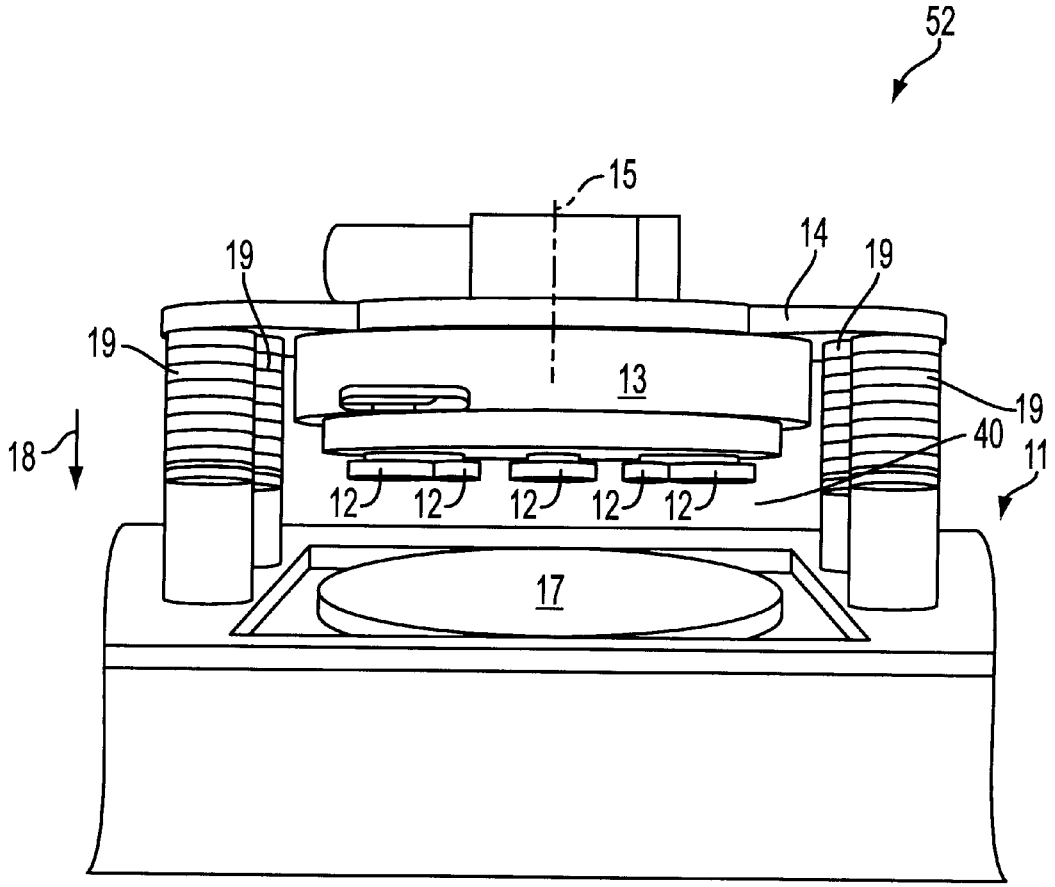
FIG. 1 is a diagrammatic illustration showing an embodiment of a typical polishing machine which includes a polishing head assembly.

With respect to FIG. 1, there is shown a polishing machine which includes a supporting structure on which is mounted a rotatable polishing surface and to which is attached a polishing pad. The polishing surface is rotated by an electric motor or other means for rotating the surface with the pad. The polishing machine also includes a polishing head assembly 40 with two major elements, the spindle assembly 120 and the wafer carrier assembly 100. The generic structure of polishing machines are known in the art and are not discussed in detail except as is pertinent to understanding to inventive polishing head assembly 40 and most particularly, inventive aspects of the wafer carrier assembly 100 and spindle assembly 120.

We first describe an overview of a particular embodiment of the inventive polishing head 100 so that the overall structure, operation, features, and advantages of the invention may be more readily appreciated. The structure and operation of particular elements of the inventive head and polishing method will then be described relative to the detailed drawings.

Figure 2:
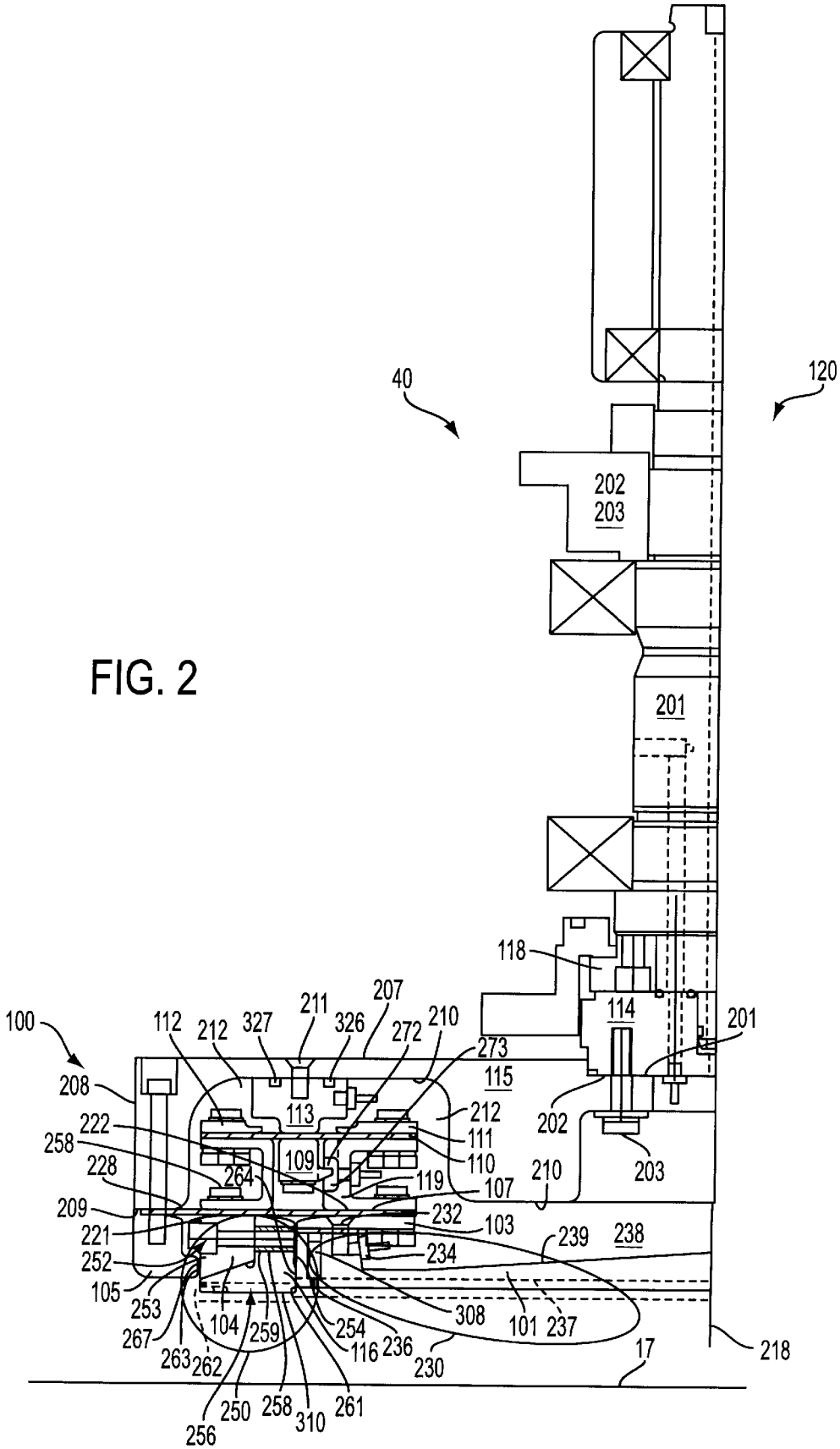
FIG. 2 is a diagrammatic illustration showing an embodiment of the inventive polishing head assembly.

A first embodiment of the inventive structure having a double-diaphragm three-chambered design is now described relative to the diagrammatic illustration in FIG. 2. Two primary subsystems, the polisher head assembly 40 comprises the wafer carrier assembly 100 and the spindle assembly 120. Note that in some instances the term 'head' is used synonymously with "carrier" in the art, and that the term "sub-carrier" then refers to the portion of the apparatus to which the wafer is attached or held. The polisher head assembly is in turn mounted to the remainder of the polishing machine 52, which may itself include one or a plurality of such polishing head assemblies 40. The term polishing head, polisher head, polishing head assembly, and polisher head assembly shall be used synonymously in this description. The terms spindle assembly and spindle shall also be used synonymously in this description.

A surface 201 of wafer carrier assembly 100 upper housing 115 is mounted to a spindle assembly 120 mounting adapter 114 via cap screws 203 or other fasteners or fastening means. Spindle assembly 120 provides means for coupling a rotational movement to the wafer carrier assembly 100 from an external rotational force generator 203, such as an electric or hydraulic motor, and means for coupling or communicating one or more fluids from stationary sources external to the wafer carrier assembly 100, and even external to the polishing head assembly 40, to the wafer carrier assembly 100. As described hereinafter, the fluids may include but are not limited to water (including deionized or DI water) and air or other gases. The fluids (liquid or gaseous) may be at positive or negative pressure relative to the ambient pressure of the polishing machine. In this context, vacuum is considered a negative pressure. A rotary union 206 is provided for coupling fluids to the carrier assembly 100. One exemplary rotary union is described in U.S. Pat. No. 5,443,416 which is hereby incorporated by reference.

Upper housing 115 is connected to mounting adapter 114 as already described and provides a stiff main body to which other elements of carrier assembly 100 are mounted or suspended. Upper housing 115 has an external top surface 207, an external side surface 208, a bottom surface 209, and an internal surface 210 which has planar, concave, and convex surface regions to facilitate the formation of chambers and provide mounting surfaces for other elements, as well as providing a substantially stiff structure to receive and impart the rotational motion from the spindle assembly 120 to the wafer, as described hereinafter. A housing seal ring 113 is mounted to the upper housing inner surface 210 via screws 211 or other fasteners. The housing seal ring 113 has two O-rings 326, 327 in the mounting surface to eliminate any potential fluid or pressure leaks between first and second chambers (chambers 1 and 2) and leaks to the outside of the head through screws 211. Pressure to the retaining ring pressure chamber 2 is provided through the nipple connector in 113.

Advantageously, the housing seal ring 113 is attached via screws 211 through the external top surface to facilitate assembly and disassembly of carrier assembly elements suspended from housing seal ring 113 within the housing cavity 212. The shape of the upper housing was advantageously chosen to minimize internal volume, thereby allowing for quicker time response when pressure is changed.

A secondary diaphragm 110 is mounted to a lower surface of housing seal ring 113 opposite the surface mounted to the inner upper housing surface 210. It provides pressure isolation between the three chambers while at the same time allowing for substantially frictionless (or low friction) vertical motion of the retaining ring assembly 104, 116 and the sub-carrier 101. Diaphragm 110 also provides torque transfer to the retaining ring assembly and the sub-carrier. While the flat or substantially flat, flexible diaphragm is the preferred structure, other flexible elements such as metal or polymer bellows, accordion layers, or shaped, closed polymer tubing may be used alternatively as the connecting means.

Materials such as stainless steel, stainless steel alloys, other metal alloys having suitable corrosion resistance and mechanical stability and polymer materials, including for example, silicone rubber may be used for the diaphragm. In one embodiment of the invention, where a flat diaphragm is implemented, it is advantageously made from materials such as EPDM (FAIRPRENE DX-0001), Nitrile (FAIRPRENE BN-5039), or expanded PTFE (INERTEX). If a bellows construction is used, materials such as stainless steel or stainless steel alloys are advantageously used. The flat diaphragm is preferred as it provides the desired functionality better than a bellows, and at lower fabrication and assembly cost.

One important function provided by secondary diaphragm 110 is that it transmits rotational torque from the upper housing 115 to inner flanged ring 107 and outer flanged ring 108 while allowing each to float independently of the other. In this description, we use the term "float" to mean that there are minimal binding (mechanical) or frictional forces between the elements mounted to the diaphragm that could counter the effects of applied pressure. The elements move with minimal oppositional forces in the vertical direction (up/down), but are essentially held rigidly in the plane of rotation (horizontal). Floating also allows some minimal, but sufficient, angular variation about any axis aligned on the surface of the wafer being processed. As used in this application, the term "float" also includes movement in the manner of a buoyant object on the surface of a liquid. That is, float includes the ability to move vertically up and down relative to the polishing pad so that vertical positional differences may be accommodated without any binding or resistance, as well as the ability to tilt or undergo angular variation about any axis passing along an imaginary line running at the wafer polishing pad interface. The substrate such as the wafer floats in the manner of a buoyant object on the surface of water. A flat diaphragm or membrane and flexible bellows both provide for minimal vertical oppositional forces and rigid torque transfer in the plane of rotation, with the flat membrane being the preferred simpler method. In the event that for a particular application, only a two chambered design in required, only a single diaphragm or connecting means is required for the retaining ring and for the carrier (sub-carrier).

The "second" diaphragm 106 also serves to isolate the "edge pressure" chamber 3 from the subcarrier pressure chamber 1 and the retaining ring pressure chamber 2. The floating subcarrier and retaining ring assemblies are mounted to ring 113 by the rigid ring 109. The lip on element 109 serves as a mechanical stop, limiting the extent to which the retaining ring assembly 104, 116 and the subcarrier assembly 101 can be moved "in" or "out." Two "C" section rigid mounting rings 108, 119 are mounted to the first diaphragm 110 by two flat ring assemblies 111, 112. These flat ring assemblies effect a pressure-tight seal, isolating the first, second, and third chambers (chambers 1,2 and 3) at the first diaphragm. Pressure (or vacuum) is applied to the third chamber (chambers 3) through the nipple connection in element 119.

The second diaphragm is mounted to the outer housing 115 and a sealing ring 105 to form a pressure-tight seal and a method to hold the outer edge of the second diaphragm in place. The subcarrier is mounted to the C-ring 119 through a rigid ring 103. This connection, including the inner edge of the second diaphragm 106 provides a pressure tight seal for isolation between the first and third chambers. Ring 103 is mounted to the subcarrier 101 through a gasket 102, providing a leak-tight seal to the wafer pickup holes 308. Vacuum, water and gas pressure is provided to the hole array 308 through the nipple 234 in the subcarrier 101. In this way, the hole array 308 serves as a vacuum pickup for the silicon wafer, a gas pressure method for wafer release, and a water flush to remove slurry or other material from the small holes. The combination of the first diaphragm 110, the second diaphragm 106 and the C-section ring assembly 119 mounts the subcarrier to the main housing 115 at the mounting ring 113.

The retaining ring assembly 104, 116 is mounted to the second diaphragm 106 through the C-Section ring 108. This connection serves as a pressure isolation feature between the first and second chambers (chambers 2 and 3). C-section ring 108 connects the retaining ring assembly to the first diaphragm 110. Applying positive or negative pressure to chamber 2 through the nipple connection in ring 113 allows independent operation of the retaining ring assembly with respect to the subcarrier 101. The two rings 104 and 116 for the retaining ring assembly. Ring 104 is connected to the C-ring 108 and forms the isolating seal between chambers 2 and 3. Ring 104 is preferably made of stainless steel, but other metals such as aluminum or titanium, or ceramic material or a polymer material can be used to construct this ring. The retaining ring 116 itself is made of a polymer; however, it too may be made of metal or ceramic or from a variety of polymer materials, depending on the process. Retaining ring assembly 104, 116 is constructed in such a way that the surface in contact with the platen 256 may vary in width, depending on the particular polishing, CMP, or other substrate polishing application. Likewise, the platen surface 256 may consist entirely or partially of an abrasive material such as diamond particles in order to effect platen pad conditioning concurrently with the polishing operation. The region under the wafer surface and between the subcarrier 101 and the retaining ring 116 is advantageously vented to the external housing atmosphere through vents in the assembly. While this feature may be eliminated from the structure, it is advantageous to provide in order to eliminate any trapped air between the platen 256 and the wafer to be polished, and in so doing improve process predictability and uniformity. The surface of 116 next to the subcarrier 101 is relieved in order to minimize any residual friction forces between the two elements during operation. An advantageous feature of the retaining ring assembly is that the retaining ring can be serviced or changed by removing the housing ring 105 and the screws holding ring 116 to the mounting ring 104.

In the illustrated embodiment, secondary diaphragm 110 is sandwiched between outer stop ring 112 on its upper surface and outer flanged ring 108 on its lower surface, and inner stop ring 111 on its upper surface and inner flanged ring 107 on its lower surface. Here the terms "inner" and "outer" refer respectively to the radial locations of these annular structures relative to the spindle shaft rotational centerline 218.

Each of inner and outer flanged ring 107, 108 has a somewhat C-shaped or U-shaped structure so as to provide structural strength and rigidity, at least somewhat in the manner of an annular I-beam type structure, and at the same time to minimize mass, weight, and inertia, and to provide surfaces for attachment to the adjoining structures. However, in general, other inner and outer flanged rings 107, 108 could have different profiles, including solid annular bar cross section, even though some performance sacrifice may occur.

Lower outer flanged ring 108 surface 221 and lower inner flanged ring 107 surface 221, are in turn mounted to an upper surface 228 of primary diaphragm 106. Primary diaphragm 106 mounts a subcarrier assembly 230 and a retaining ring assembly 250 at respective inner and outer annular regions, the subcarrier assembly 250 generally, though not necessarily exclusively, disposed within the annular retaining ring assembly 230 region. The inventive retaining ring provides, among other features, independent control of the downforces (pressure) on or against the wafer, on or against the retaining ring, and on or against the interface between the wafer and the retaining ring. Recall that the wafer is held against the front surface 237 of wafer subcarrier 101.

The primary diaphragm 106 is responsible for several functions. Firstly, primary diaphragm 106 transfers rotational torque initially received by the upper housing 112 from spindle assembly 120, and transferred to primary diaphragm 106 through several intervening structures (for example, housing seal ring 113, inner flanged ring 107, and outer flanged ring 108) to subcarrier assembly 230 (and hence to the wafer when mounted to the subcarrier assembly) and to retaining ring assembly 250. Secondly, primary diaphragm 106 substantially maintains a lateral, or in this instance radial or annular separation between wafer subcarrier 101 (an element of subcarrier assembly 230) and retaining ring 116 (an element of retainer ring assembly 250), while permitting each of subcarrier 101 and retaining ring 116 to independently float over the polishing pad mounted to rotatable polishing surface 132. The two diaphragms provide isolation of the three pressure chambers and allow the retaining ring assembly and subcarrier to "float." Pressure is applied to the subcarrier chamber 1 through an independent port in the spindle. Pressures in chambers 2 and 3 are applied independently through spindle ports.

We now briefly review an exemplary procedure for processing a substrate. First, the wafer is transferred from the head load mechanism (HLM) to the subcarrier with a vacuum applied to the vacuum holes 308. These HLM and HUM may generally be provided by robotic wafer handling devices as are known in the art and not described further here. Next, the carrier assembly is placed in contact with the platen pad which is coated or soaked in a specific supply of slurry material, and the vacuum holding the wafer against the subcarrier is released. Third, a first pressure (pressure 1) is applied to chamber 1 and second and third pressures (pressures 2 and 3) are applied to chambers 2 and 3 respectively. These pressures may be constant or may be independently varied throughout the polish cycle. In any event, the first, second, and third pressures (positive or negative) are controlled independently. Any air trapped at the surface of the wafer is vented through the retaining ring assembly. Fourth, the polishing, planarization, CMP, or other processing cycle continues for a specific time. Fifth, at the end of the polish cycle, a vacuum is supplied to the first chamber (chamber 1) in order to withdraw the wafer from the platen surface, halting the polishing action. At the same time, pressure is left on the retaining ring to ensure proper capture of the wafer. Sixth, the wafer is then transferred to the head unload mechanism (HUM) by the application of pressure to the vacuumpressure holes in the subcarrier. As soon as the wafer is ejected to the HUM, water is flushed through the vacuum-pressure holes from inside the head to clean them, and water is injected separately to the region between the retaining ring 116 and the subcarrier 101 to flush that region of any accumulated slurry or wafer debris. Finally, at the end of a predetermined period of time, the water is turned off, and the carrier is situated at the HLM (or the HLM situated proximate the carrier) to pick up another wafer, repeating the cycle.

Figure 3:
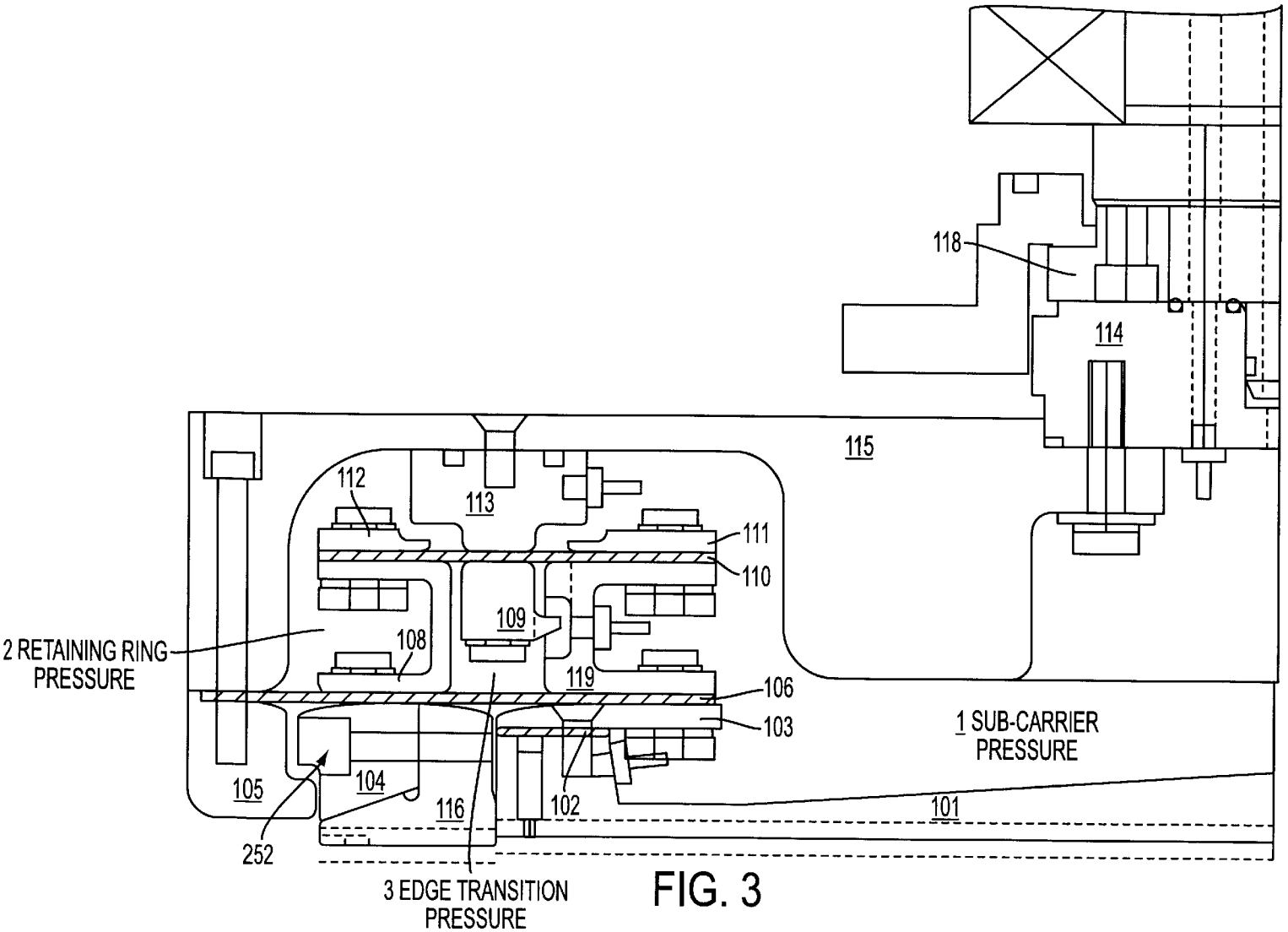
FIG. 3 is a diagrammatic illustration showing some additional structure of a portion of the embodiment of the wafer carrier assembly of the polishing head assembly in FIG. 2.
Figure 4:
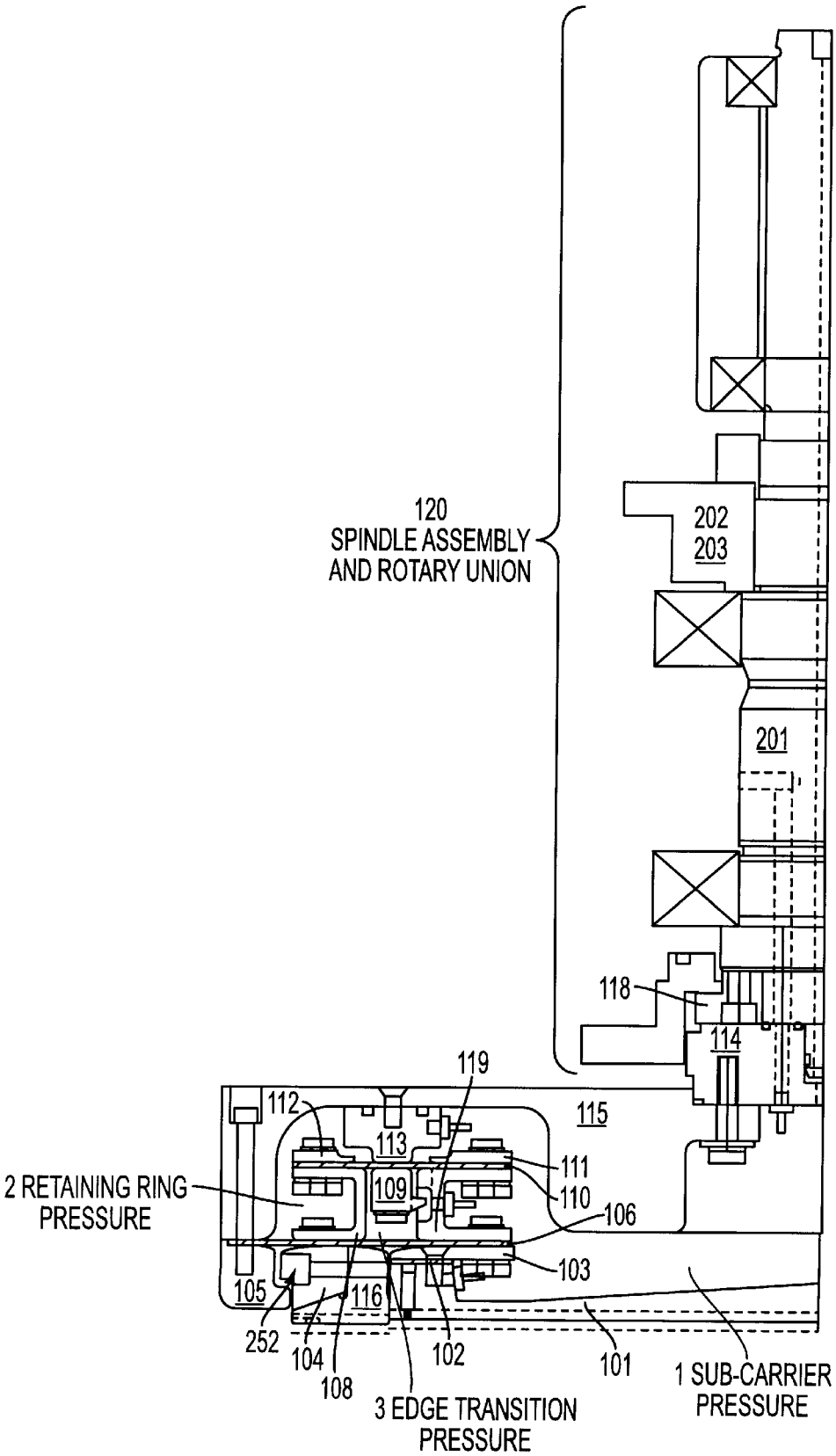
FIG. 4 is a diagrammatic illustration showing an embodiment of the inventive spindle assembly, including a five channel rotary union.
Figure 5:
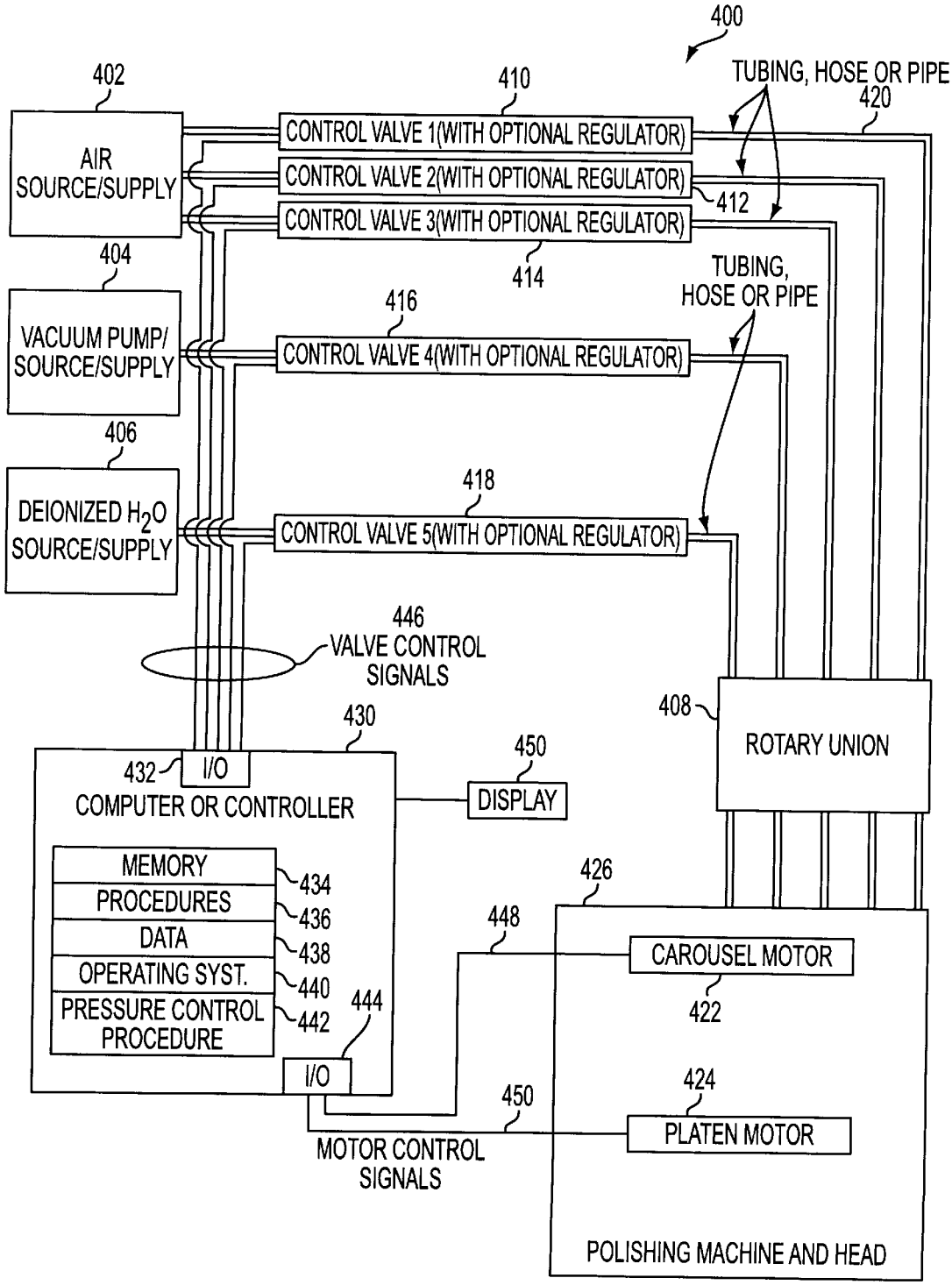
FIG. 5 is a diagrammatic illustration showing an embodiment of the pressure control system for providing independent control of pressure in first, second, and third pressure chambers, as well as pressurized water and vacuum.
Figure 6D:
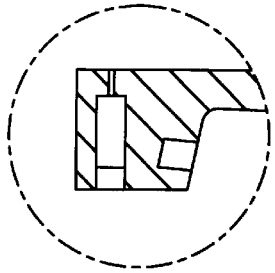
Figure 6E:
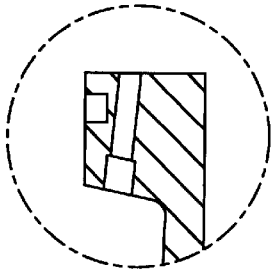
Figure 6C:
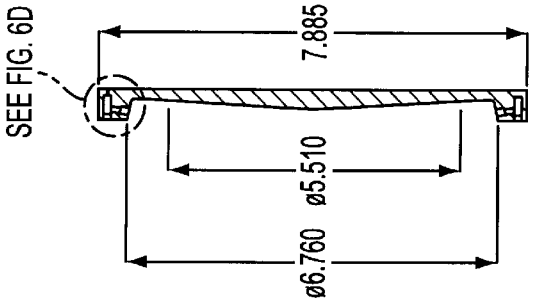
Figure 6A:
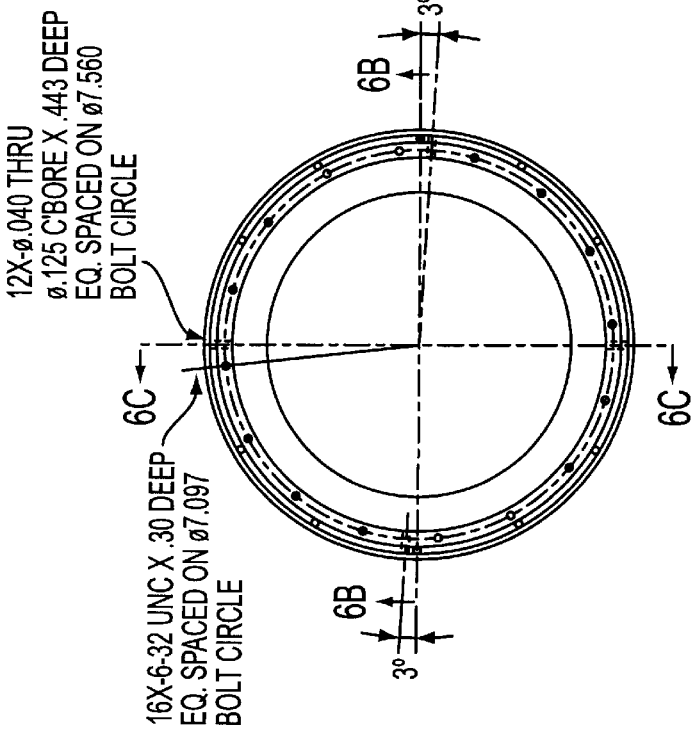
Figure 6B:
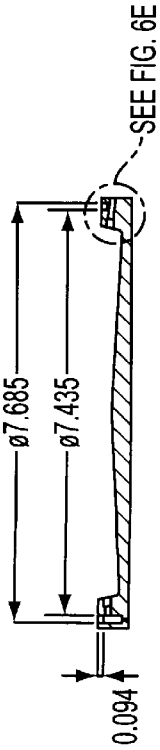
Figure 7B:
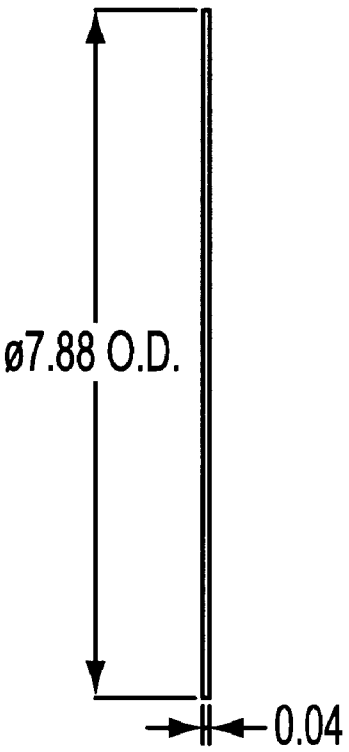
Figure 7A:
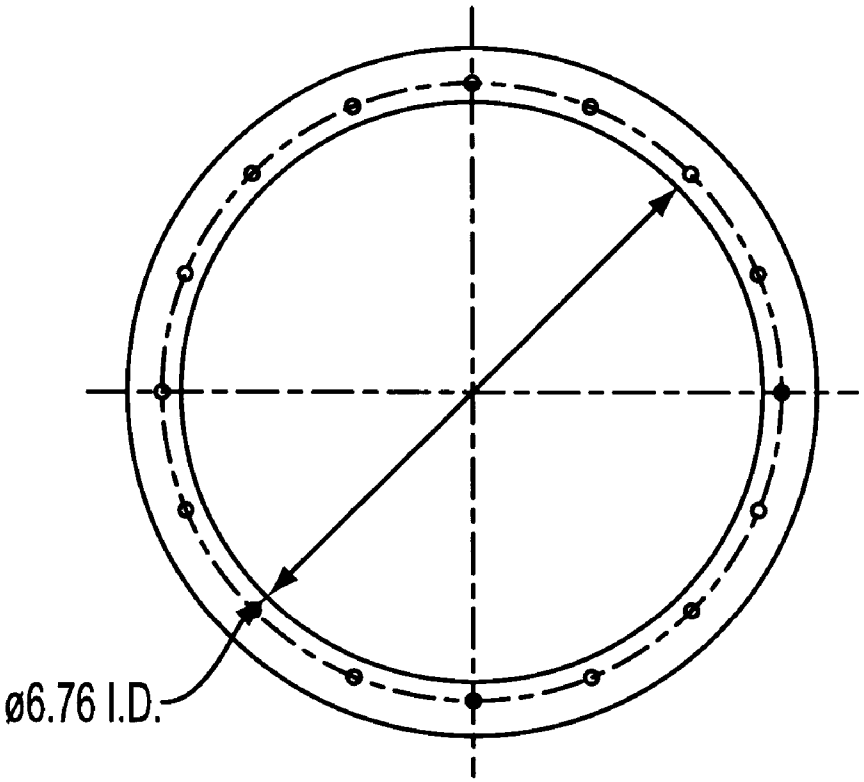
Figure 8C:
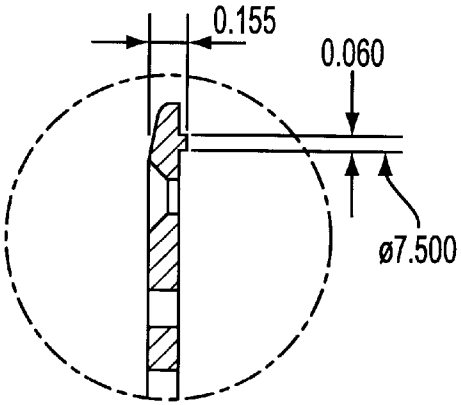
Figure 8B:
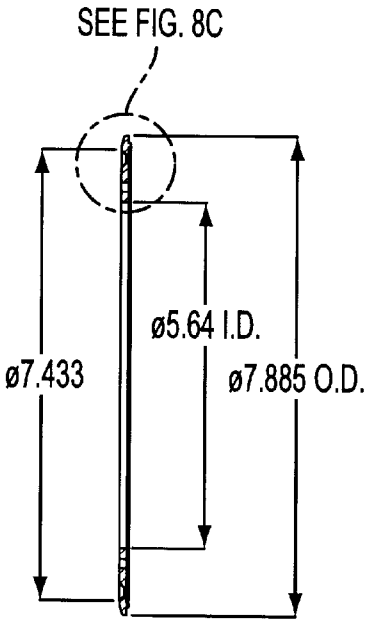
Figure 8A:
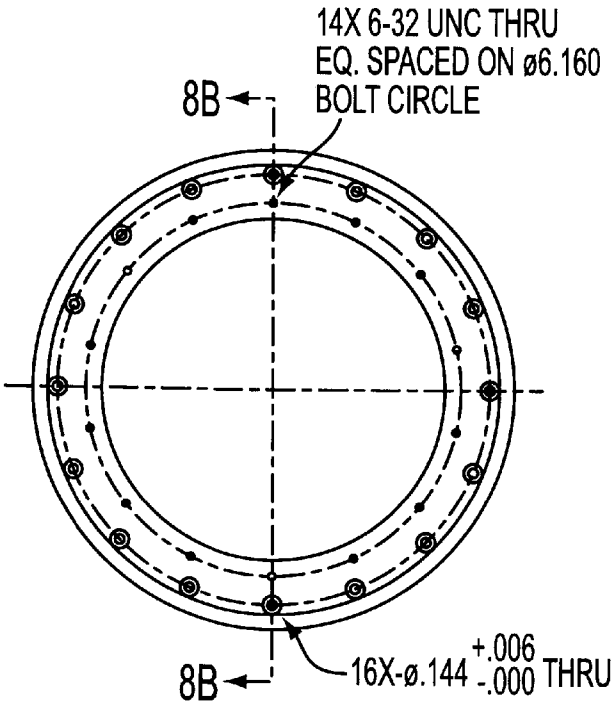
Figure 9C:
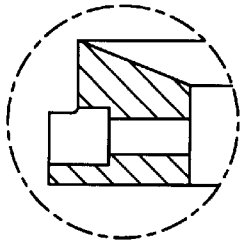
Figure 9B:
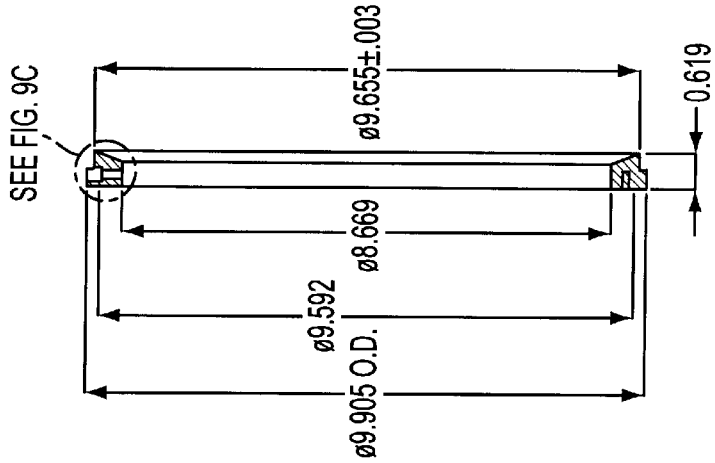
Figure 9A:
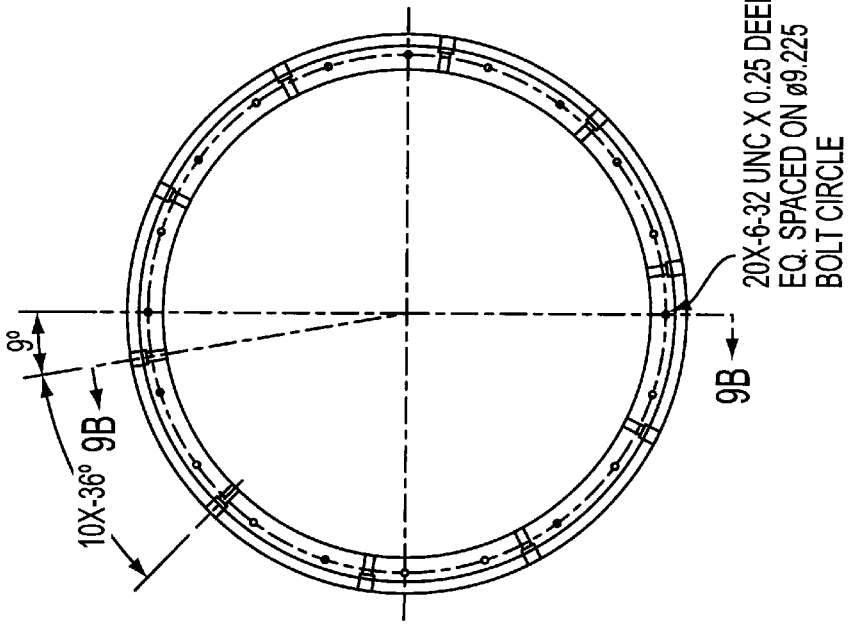
Figure 9D:
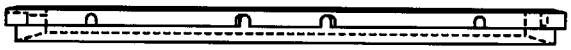
Figure 10C:
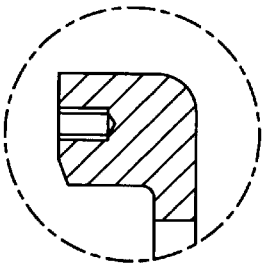
Figure 10B:
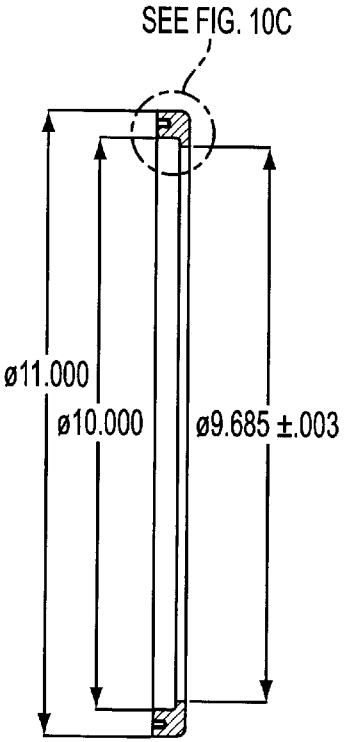
Figure 10A:
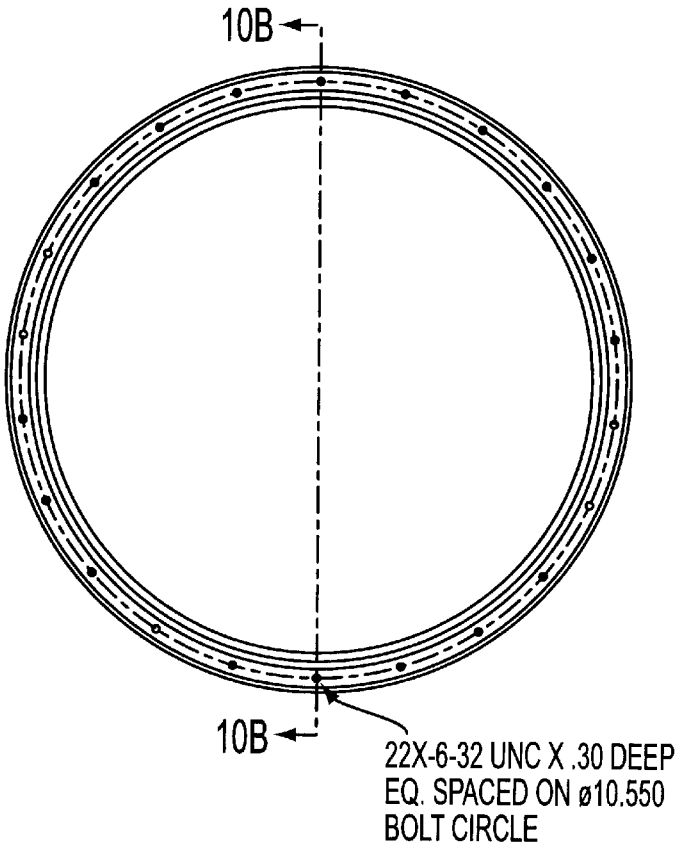
Figure 10D:
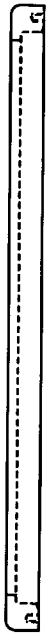
Figure 11B:
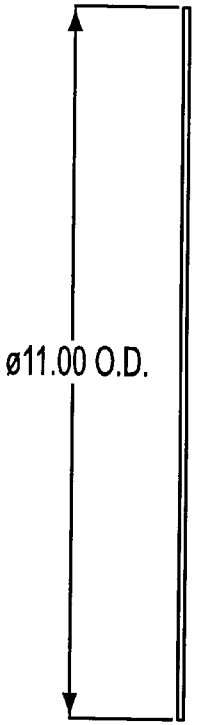
Figure 11A:
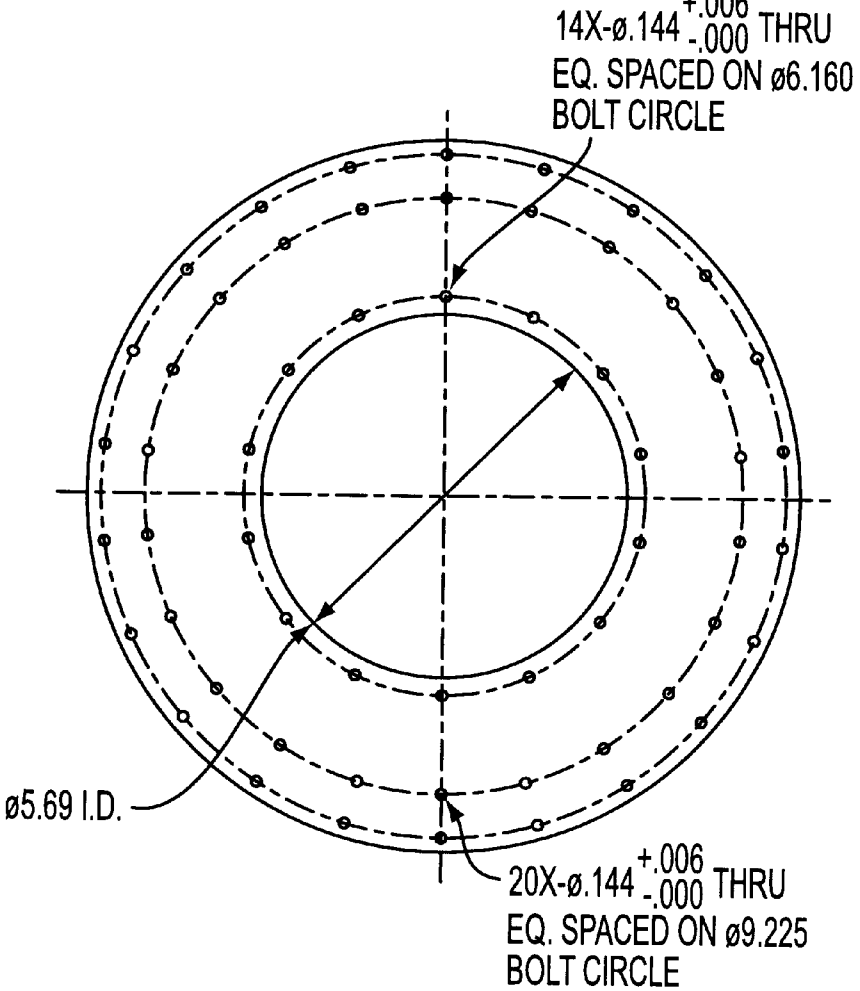
Figure 12D:
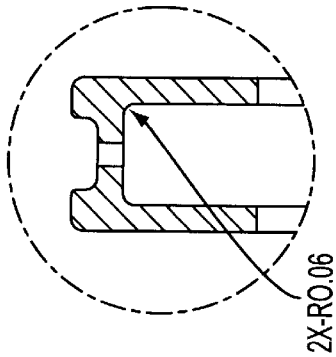
Figure 12E:
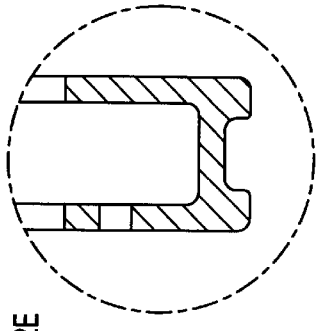
Figure 12C:
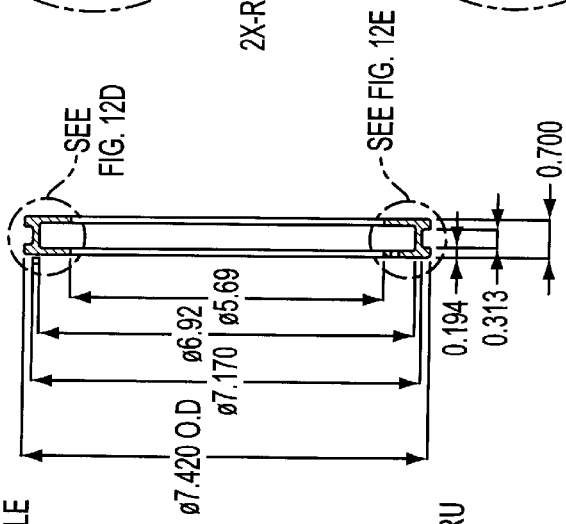
Figure 12A:
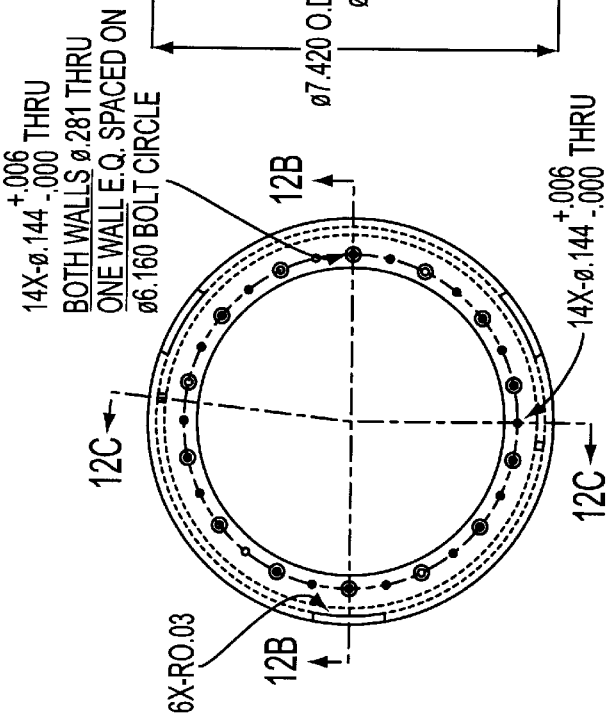
Figure 12B:
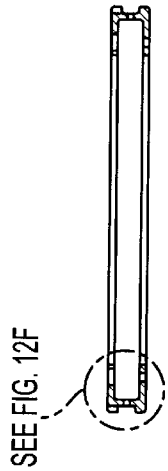
Figure 12G:
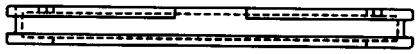
Figure 12F:
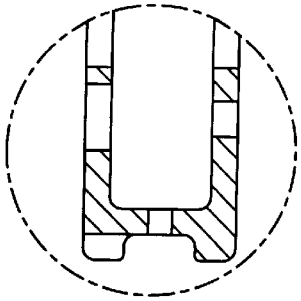
Figure 13C:
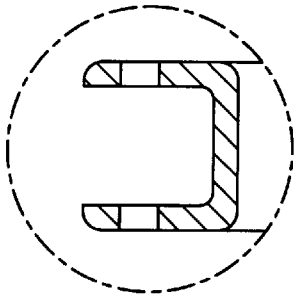
Figure 13B:
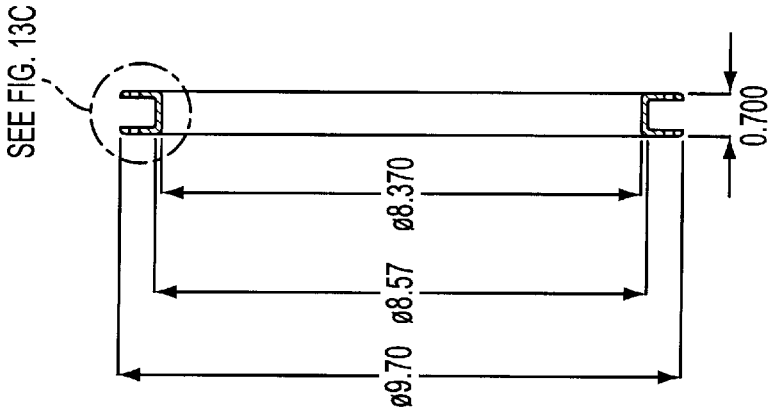
Figure 13A:
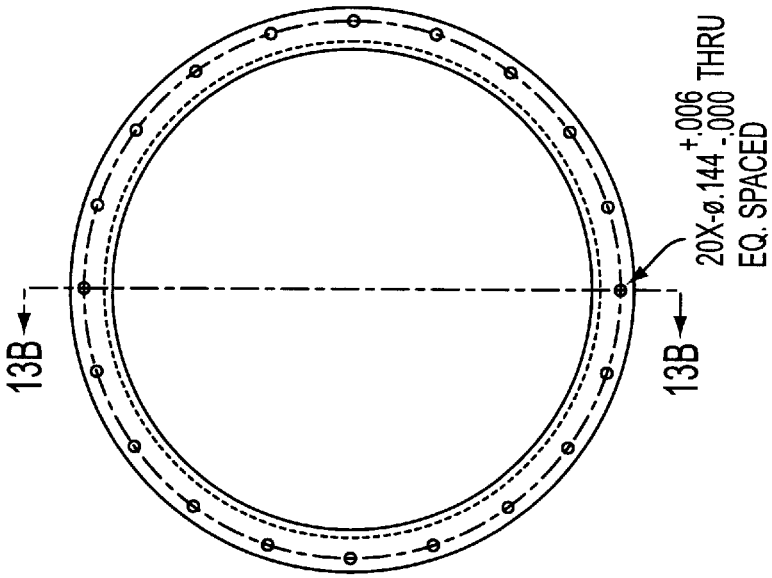
Figure 13D:
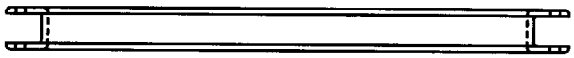
Figure 14C:
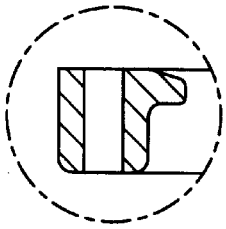
Figure 14B:
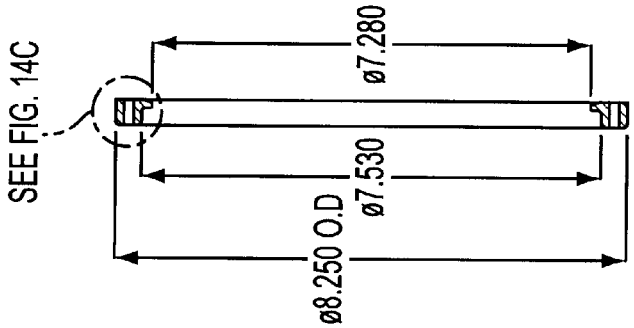
Figure 14A:
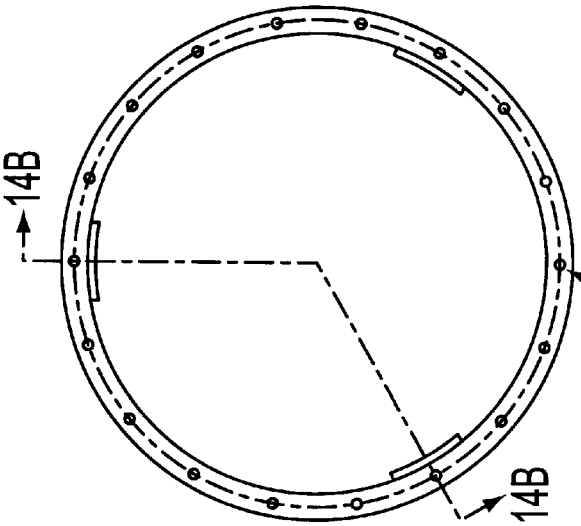
Figure 14D:
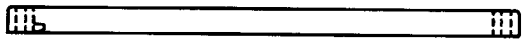
Figure 15B:
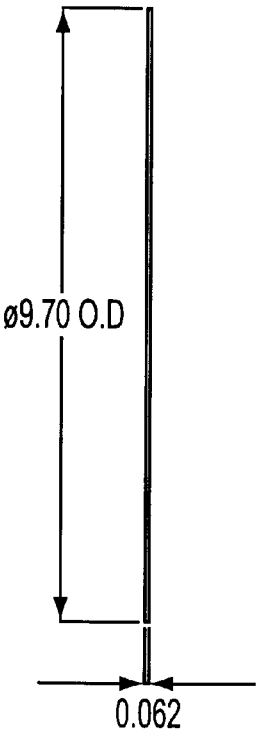
Figure 15A:
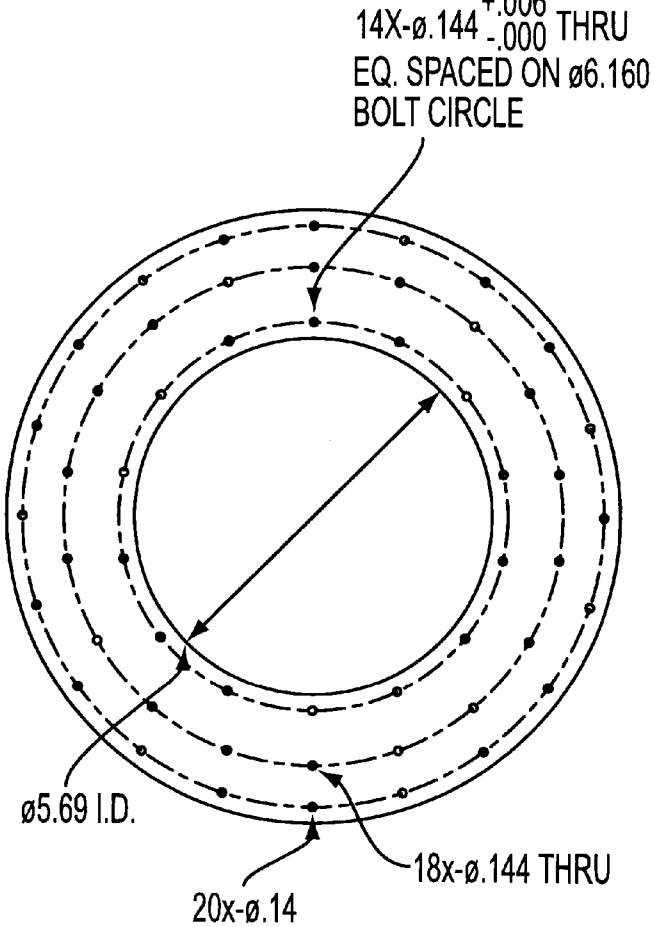
Figure 16C:
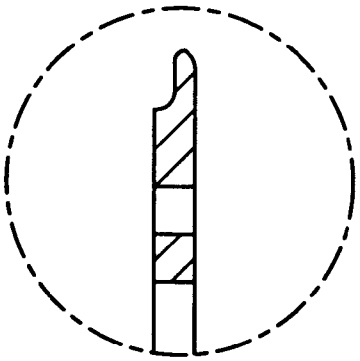
Figure 16B:
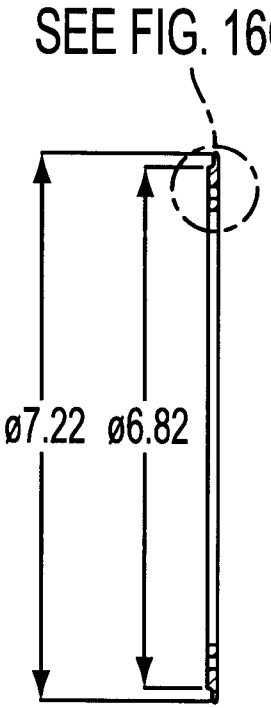
Figure 16A:
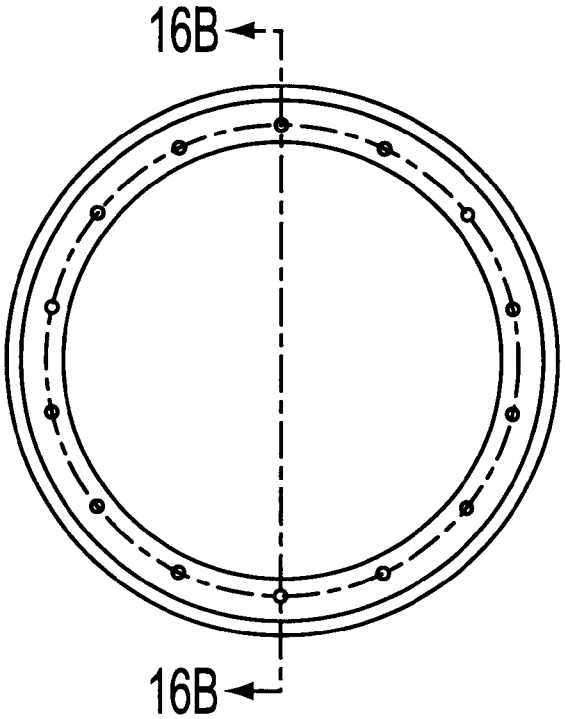
Figure 17C:
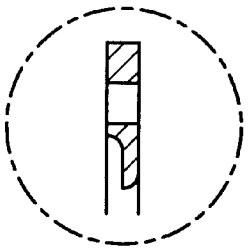
Figure 17B:
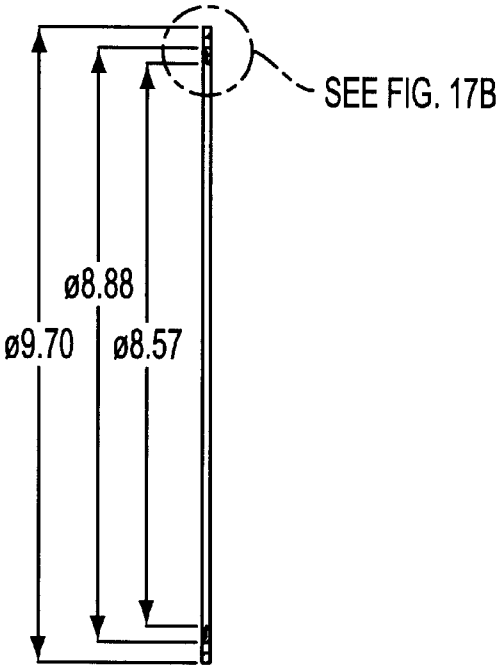
Figure 17A:
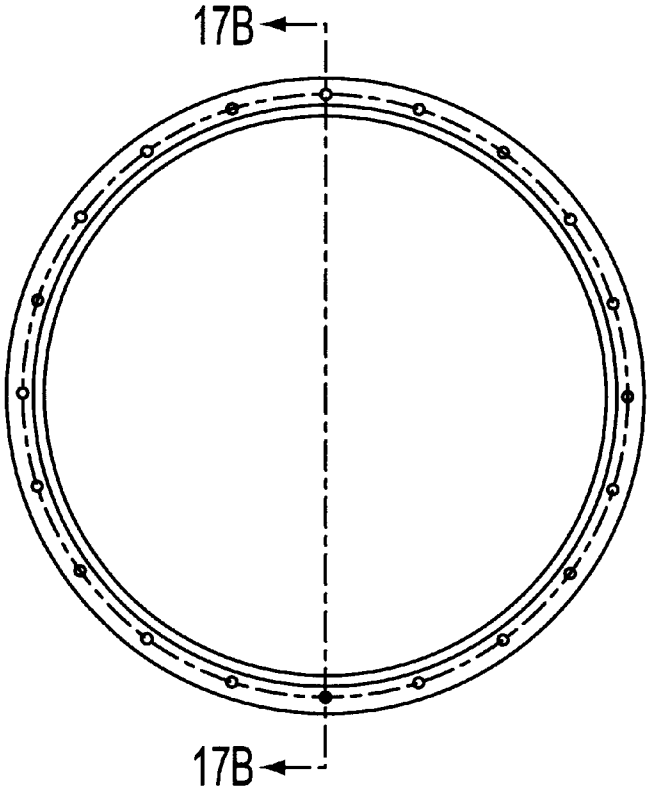
Figure 18C:
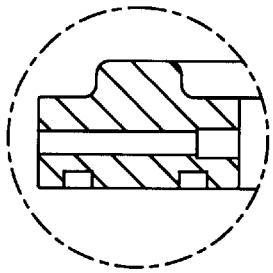
Figure 18D:
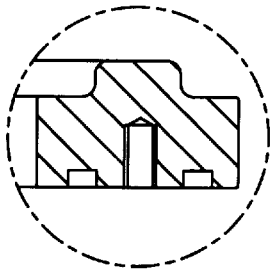
Figure 18B:
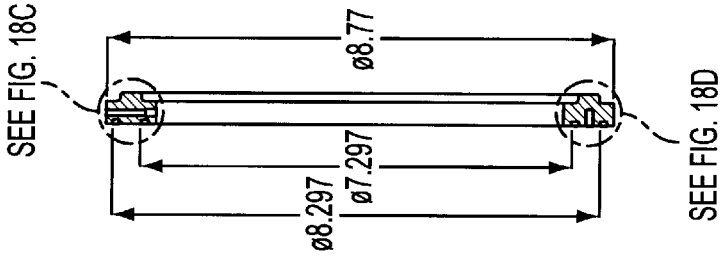
Figure 18A:
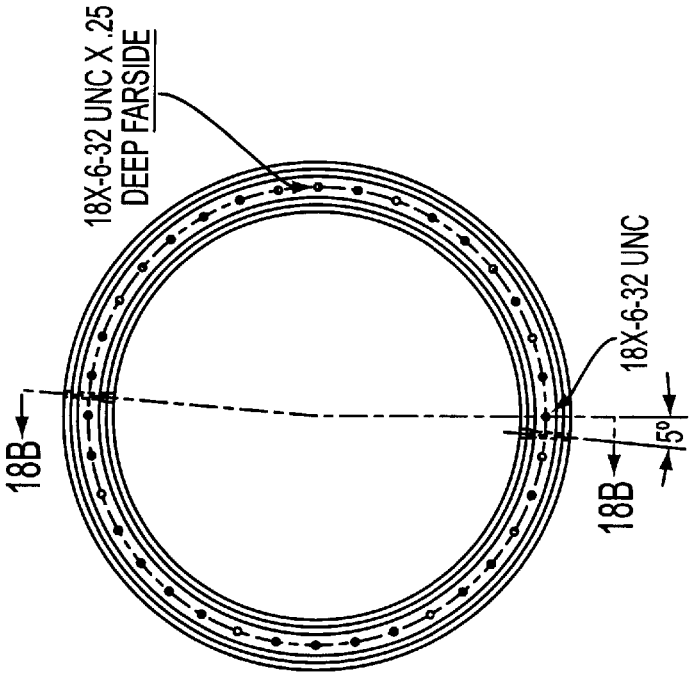
Figure 18D:
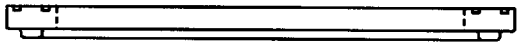
Figure 19D:
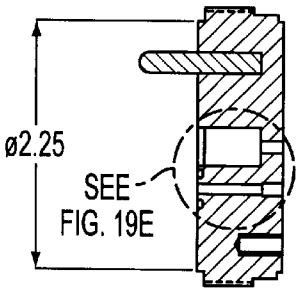
Figure 19B:
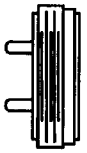
Figure 19C:
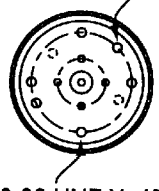
Figure 19E:
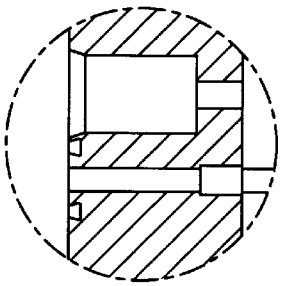
Figure 19A:
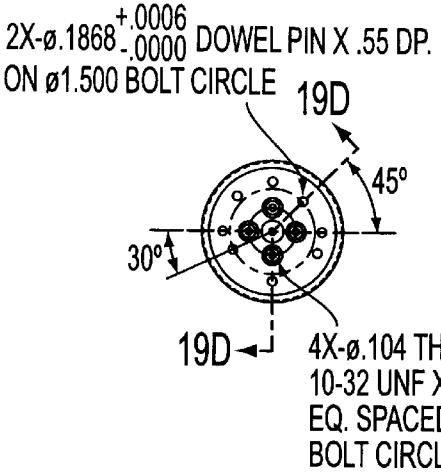
Figure 20C:
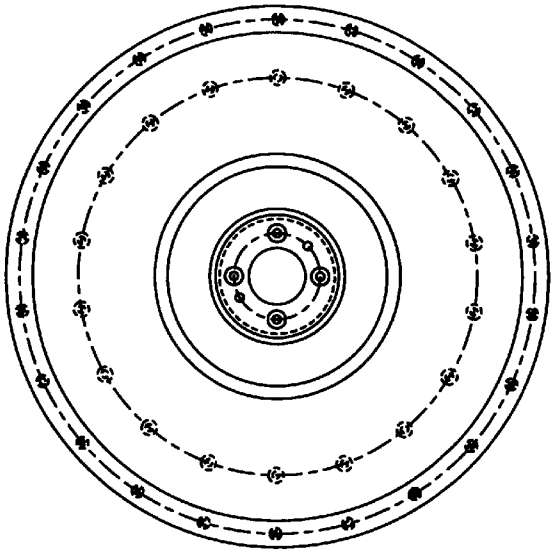
Figure 20B:
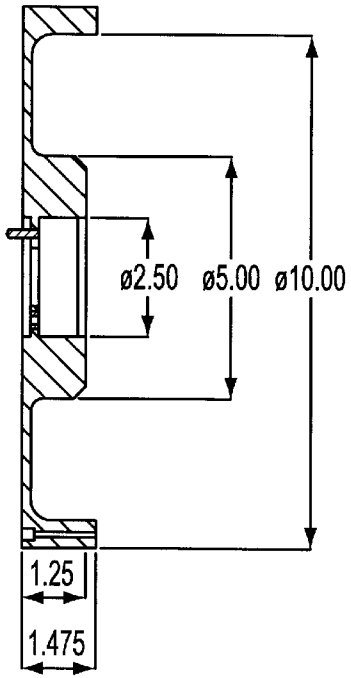
Figure 20A:
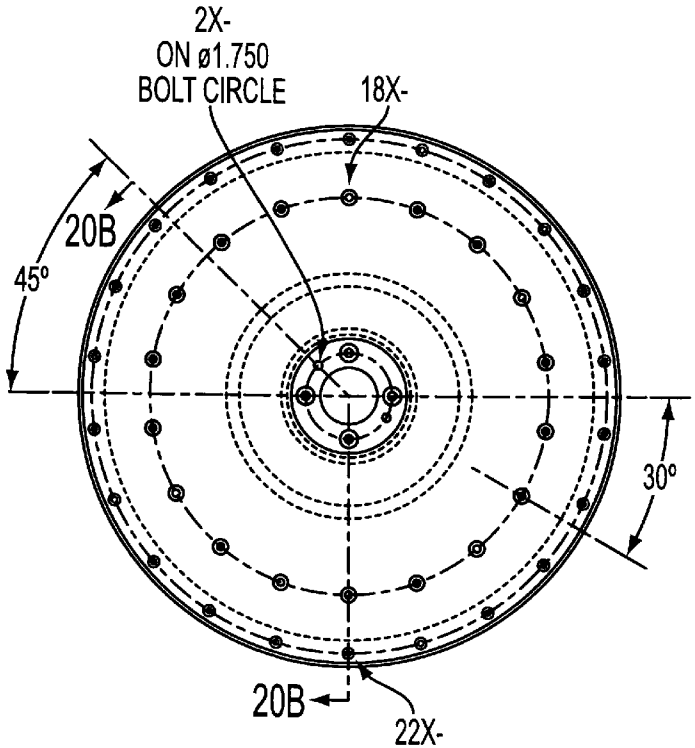
Figure 21C:
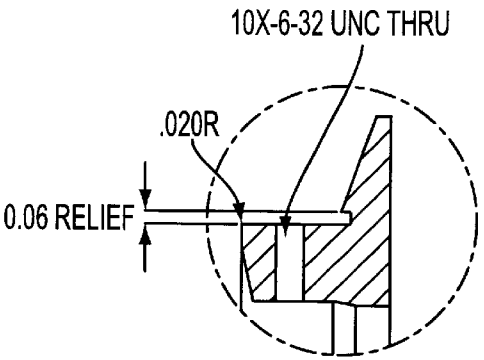
Figure 21B:
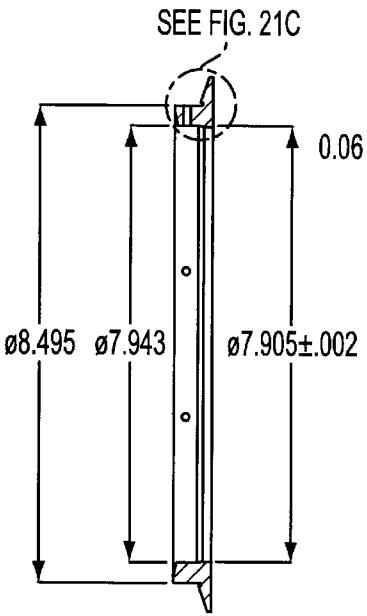
Figure 21A:
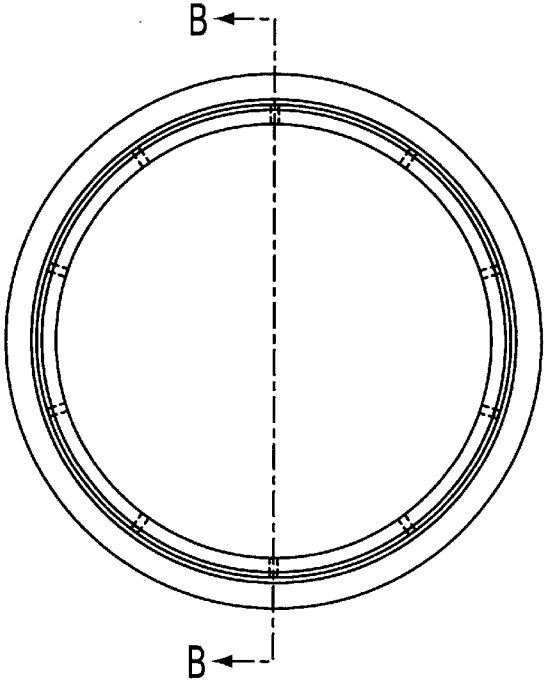
Figure 21D:
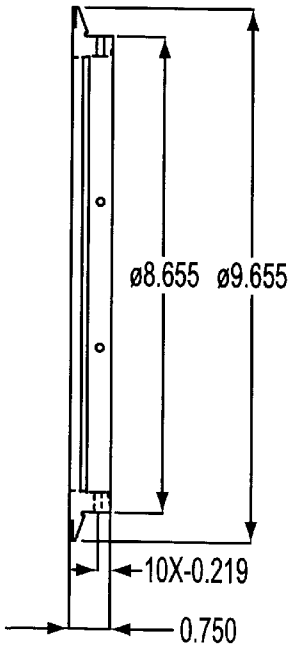
Figure 23B:
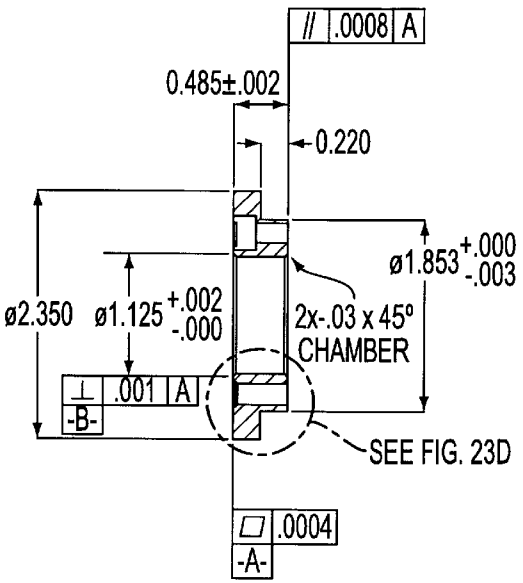
Figure 23C:
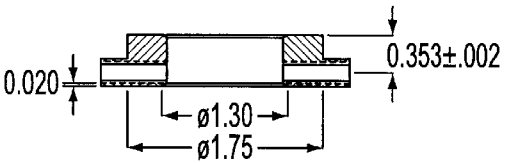
Figure 23A:
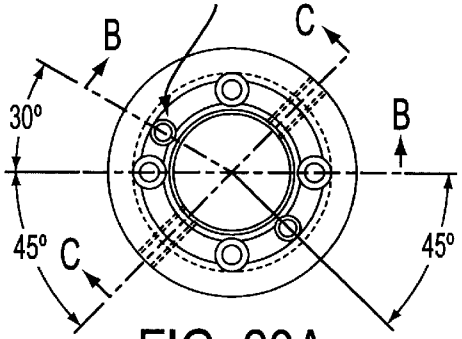
Figure 22:
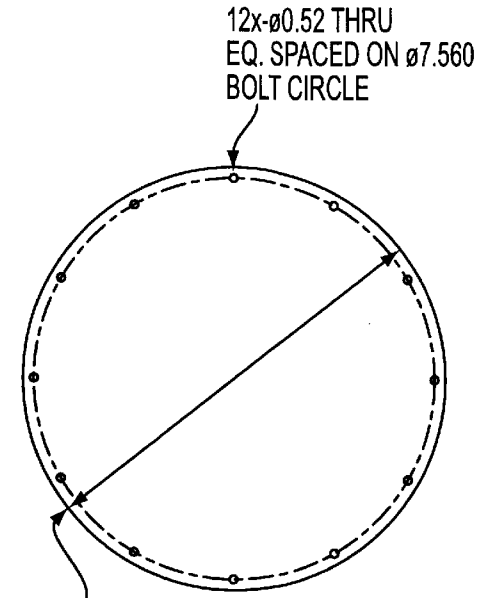
Figure 23D:
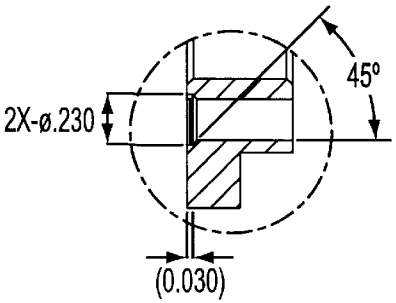
Figures 24A, 24B, 24C, 24D, 24E, 24F, 24G:
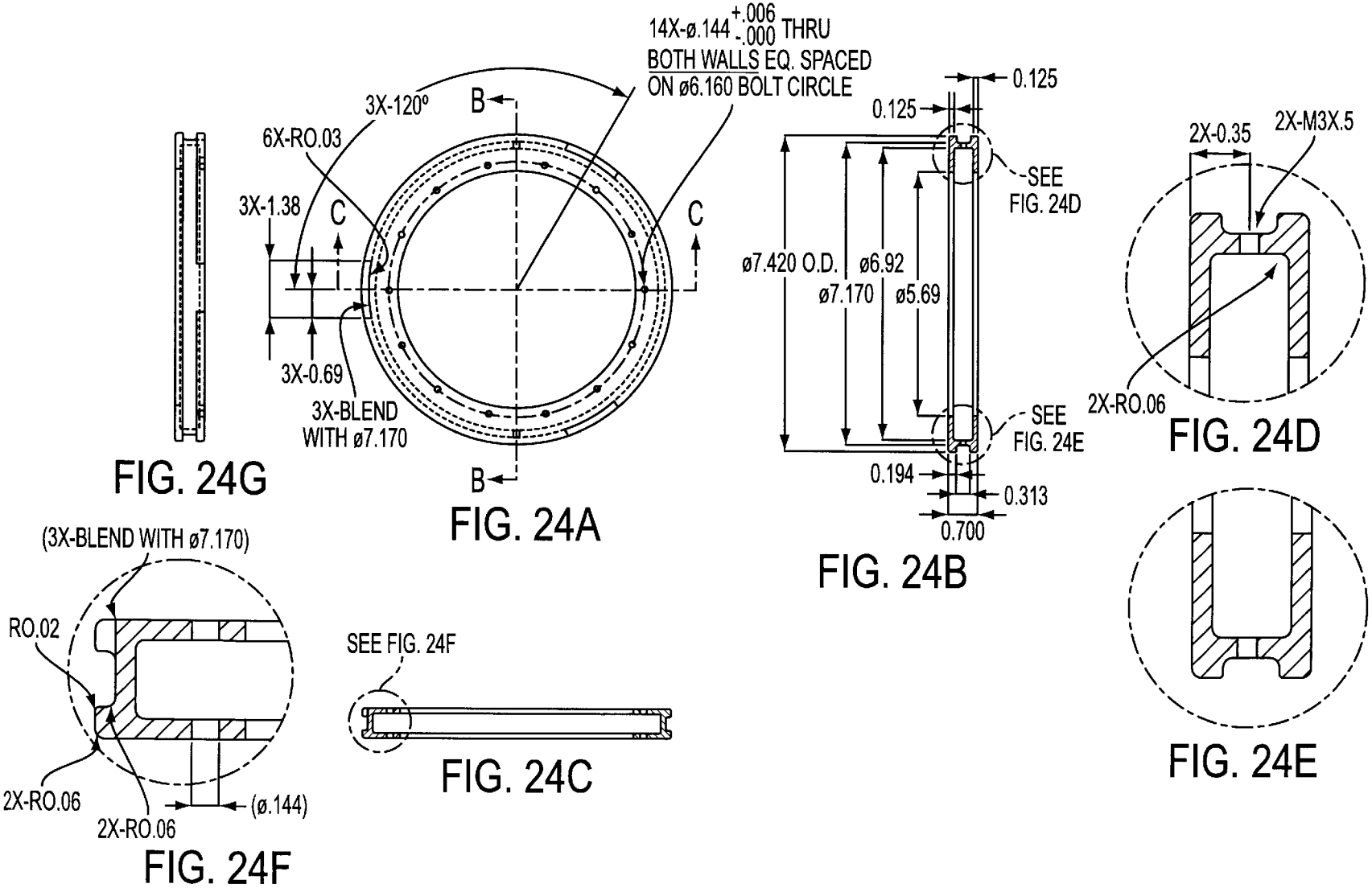
Figure 25D:
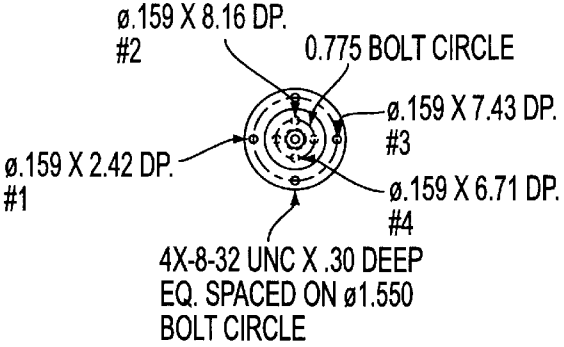
Figure 25E:
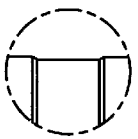
Figure 25A:
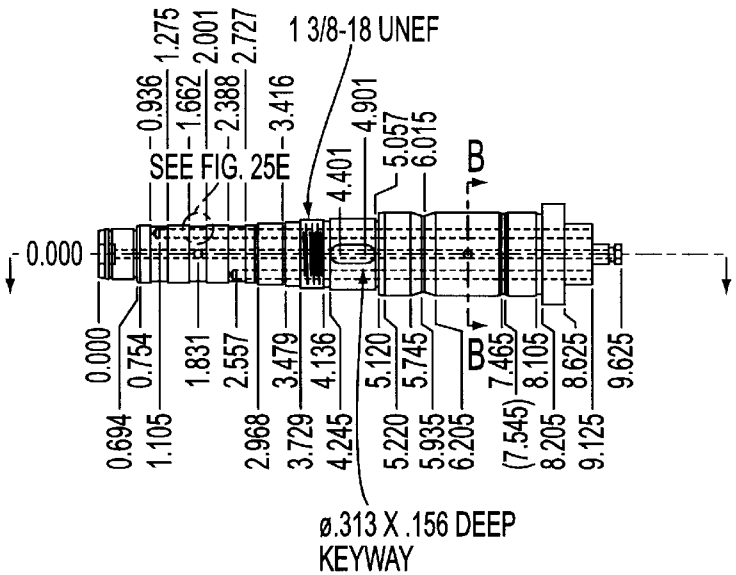
Figure 25B:
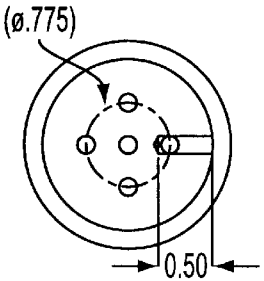
Figure 25C:
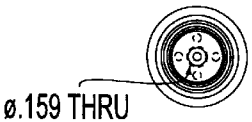
Figures 26A, 26B, 26C, 26D, 26E, 26F, 26G:
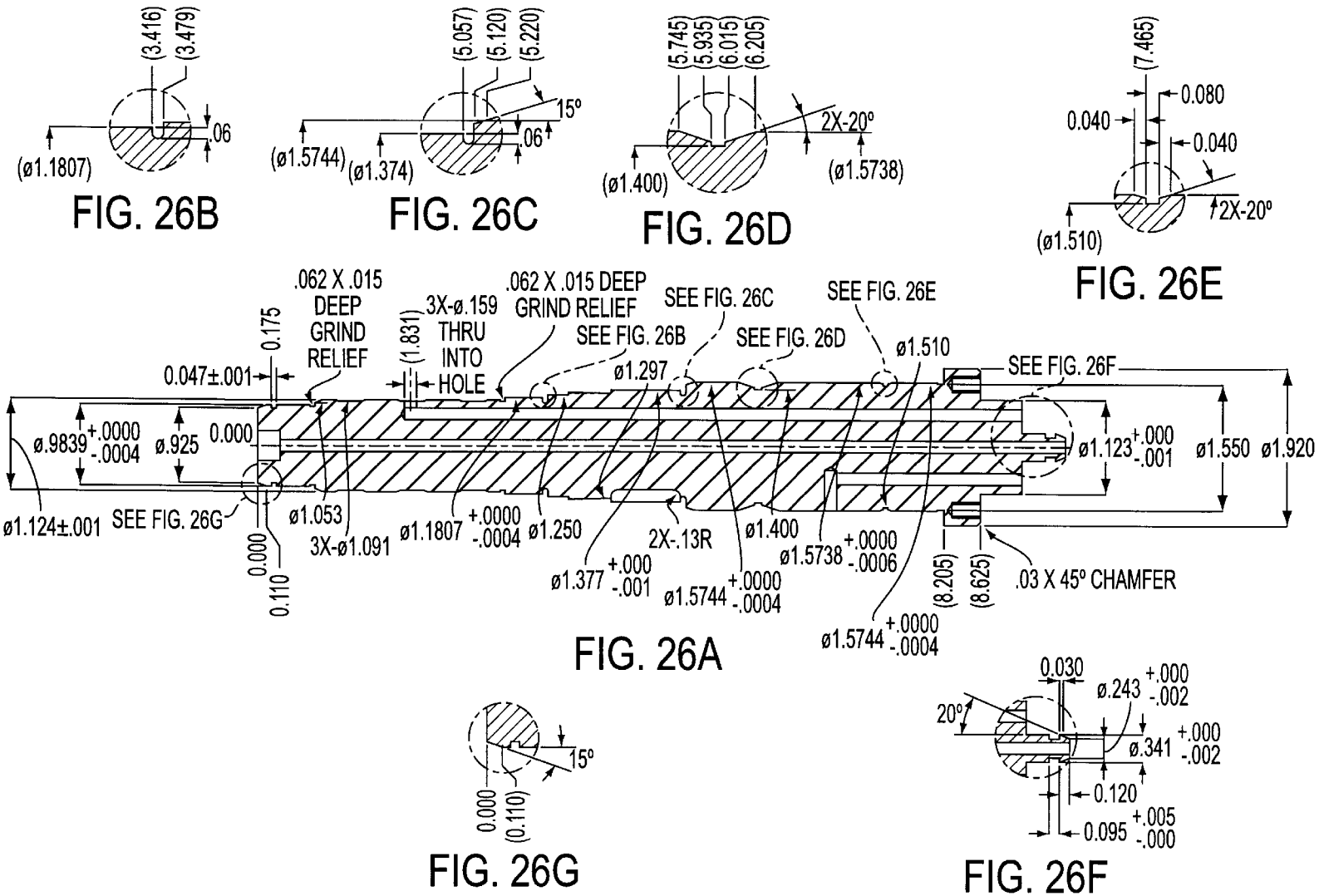
Figure 28A:
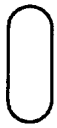
Figure 28B:
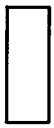
Figure 27B:
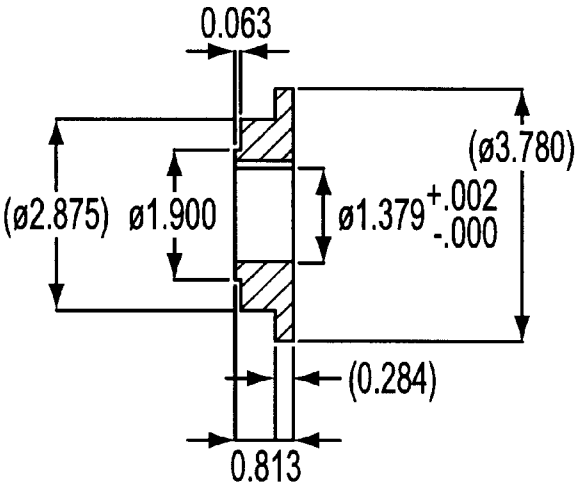
Figure 27A:
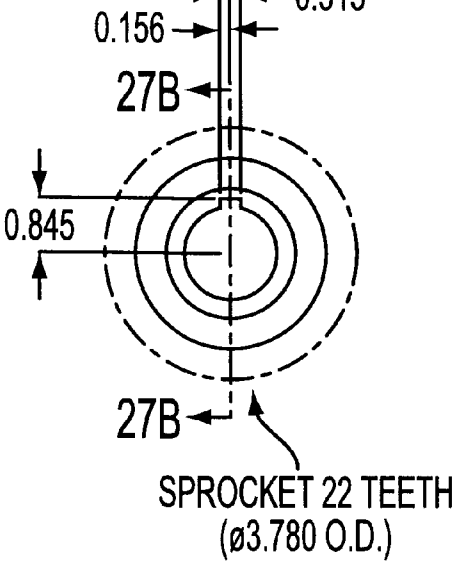

With further reference to FIGS. 2 and 3, subcarrier assembly 230 comprises subcarrier 101, subcarrier gasket 102, and subcarrier ring 103. Various fasteners, for example countersunk screws 232 in one embodiment, attach subcarrier ring 103 to the subcarrier 101 with an intervening sandwiched subcarrier gasket 102. A fitting 234 is mounted to subcarrier 101 in such manner that fluids and/or pressures may be coupled to the fitting 234 so that the fluids and/or pressure are transferred or communicated to or from one or more holes or apertures 236 on the front surface 237 of wafer subcarrier 101. A tubing fitting 234 in subcarrier 101 allows for vacuum, gas pressure, or water to be directed to the vacuum/pressure holes 236 that open on the edge of the front surface 27 of the subcarrier 101. In one embodiment, fitting 234 is fastened to the subcarrier 101 by screwing the fitting into a threaded hole in the subcarrier (when, for example a stainless steel or other metallic subcarrier is used), by using a threaded insert attached to the subcarrier (for example, a threaded stainless steel insert inserted into and adhered or bonded to a ceramic substrate), or by using an adhesive (when, for example, a ceramic subcarrier is used). The fitting includes a through-hole and a nipple or other means for connecting one side of the fitting with a tube or other fluid conduit so that fluid such as water or gas can be communicated from a fluid source via the spindle rotary union 270.

In one embodiment of the invention, the fitting is capable of delivering vacuum (such as a vacuum of about 25 inches of mercury), water (such as water at about 12 psi), and air or other gas (at a pressure of about 25 psi), and the subcarrier apertures are sized to are sized to minimize any potential mechanical deformation to the wafer edge. Such deformation may possibly occur in the holes are made too large or too great a number of holes are provided. In one embodiment the subcarrier apertures 236 are about 0.005 inch diameter holes, but larger or smaller holes may be used provided that they are not so large as to cause deformation. Holes should also have sufficient size that they do not clog with slurry or wafer polishing debris. The water and/or air flush of these holes can assist in using small diameter holes that do not clog. A cavity 238 between the subcarrier backside 239 (the side away from the wafer mounting surface) of the subcarrier 101 and the inner housing surface 210 provides a volume of space sufficient for this and other tubing without interfering with the movement of subcarrier 101.

The subcarrier assembly 101 is advantageously formed from the subcarrier 101 and subcarrier ring 103 separated by gasket 102 rather than from a single piece. The gasket 102 provides pressure isolation to the vacuum/pressure holes 236. The subcarrier ring 103 provides both a sealing surface for membrane 106 and a rigid mounting mechanism for subcarrier 101 to the C-ring 119.

Retaining ring assembly 250 has a generally rectangular annular ring overall composite structure with inner 253 and outer 254 side walls, and upper 255 and lower 256 surfaces and comprises retaining ring adapter 104, retaining ring 116, and an optional wear surface 251 attached to, or formed integral with, retaining ring 116. Each of the side walls and upper surface advantageously have surface conformations that provide additional benefits. The wear surface is optionally provided at the lower retaining ring surface 256 in order to move the "edge" polishing effects that may occur away from the edge of the wafer to the edge of the retaining ring so that such edge effects do not degrade polishing uniformity. In one embodiment, the wear surface 251 is between about 2 mm and about 5 mm thick, though it could be thicker or thinner, and, in one embodiment, is made from ceramic or polymer material. A vented screw 252 is also provided to secure retaining ring adapter to retaining ring 116 through side wall 254, though other venting means, such as a through hole, could alternatively be provided.

Retainer ring adapter 104 is attached to outer flanged ring 108 by a threaded cap screw 258, though other types of screws or fastening means may be used, to retaining ring 116. In one embodiment of the invention retainer ring adapter 104 is made from passivated 316/316L stainless steel, where passivation is in accordance with MIL QQ-P-35 Type II standards. Retaining ring 104 is made from TECHTRON™ PPS (polyphenylene sulfide). Desirably, stainless steel or other corrosion resistant material helicoid threaded inserts 258 are affixed through holes 259 in the retaining ring in order to accept threaded screws attaching the retaining ring 116 to the retaining ring adapter 104.

In one embodiment of the invention, vented screws 252 are advantageously used to join the two elements of the retaining ring assembly 250. Unless the gap 318 between the subcarrier assembly 230 and retaining ring assembly 250 is vented via a vent hole 319 or other venting means, an air bubble may possibly develop in the gap which may then spread under the wafer between the backside wafer surface **305*b* and the outer wafer subcarrier surface during the polishing process. The presence of such an air bubble may then causes a lack of process control and non-uniformity of the polishing process. The vented screws allow for the escape of any entrapped air from the gap 318 to region between the outer wall of the retaining ring assembly and the inner wall of the lower housing 105** where the escape of small amounts of air, should they occur, have no effect on the polishing operation. Furthermore, since the vent hole is within the housing, polishing slurry contamination is kept to a minimum.

The carrier assembly 100, also desirably but optionally, has a two-piece retaining ring. The actual retaining ring 116, which contains the wafer and the polishing pad, is generally of an inert polymer or ceramic material, but can be made of virtually any material compatible with the chosen polishing, planarization, or CMP process. It is also designed and fabricated to allow for rings of varying annular dimensions to be used, up to a width of about one inch, although this one-inch dimension is exemplary and not an absolute limitation of the invention. This ring may, optionally, also incorporate a region with a rough surface, such as diamond, that performs as a polishing pad conditioner. The ring 116 is mounted onto a metal or ceramic ring 104 that is mounted to the solid outer flanged ring 108 which serves as a drive ring. When chamber 302 is pressurized, the pressure causes the retaining ring assembly to be controllably forced onto the surface of the main polishing pad. This controlled retaining pressure ring serves to minimize edge effects common to conventional carrier-platen polishing process.

Of the inert ring 116 materials available, the polyphenylene sulfide material is advantageous for several reasons. First, it is inert relative to the conventional CMP polishing slurries which can be corrosive to some materials. Second, it is wear resistant and chemically inert. Therefore, for subcarriers made from either ceramic material, stainless steel, Invar, or other conventional wafer subcarrier 101 materials, the polyphenylene sulfide material provides a good self-lubricating, relatively friction free, wear surface. An advantage of the two-piece ring is that the ring 116, which is subject to some wear, can be changed without disassembly of the entire carrier assembly as is typically required for conventional structures.

Therefore although a single piece retaining ring assembly may alternatively be provided, the two piece retaining ring assembly 250, benefits from the strength and stiffness of the metal retaining ring adapter 104 and the special material properties of the polyphenylene sulfide ring and the other advantages described above. Alternative retaining ring 116 materials will include other polymer materials, ceramics, composites, special metal alloys and silicon carbide.

In one embodiment of the invention, the lower surface of the retaining ring, that is the surface which contacts the polishing pad, may desirably be trimmed to remove material from the outer annular radial portion. Before any trimming, in a polishing head sized for chemical mechanical polishing (CMP) of 300 mm silicon based semiconductor wafers, the retaining ring has a polishing pad contact width of about 25 mm. However, the ring may be trimmed to lessen the contact width to a width as small as about 10–12 mm, or enlarged to have a width of about 30 mm or more, or any width between these two annular widths. This adjustability advantageously permits precise control over the edge effects of the polishing process. Retaining ring 116 and wafer subcarrier 101 define a pocket 270 in which the semiconductor wafer (or other substrate to be polished) is placed and retained during polishing.

We also note that, in one embodiment, wafer attachment detection sensors provided in the vacuum line determine or indicate that the wafer is properly in place on the front surface of the carrier. The pressure control system is comprised of three electronic pressure control devices that maintain independent control of pressures in the first, second and third chambers (chambers 1, 2 and 3). The pressures in these chambers range from vacuum (some negative pressure) to about 15 psig positive, and may be varied during the process cycle. Larger pressure may be used but typically are not needed. Pressures are applied independently through the channels extending through the spindle and connecting with the external fluid and/or pressure supplies or sources. The application of fluids and pressures are controlled, such as with a computer control system operating in conjunction with either open-loop control system, or preferably feedback control systems.

A locking ring 109 with ridge 272 or series of protuberances is fixedly mounted to the housing seal ring 113 by screws 271 or other fastening means. Ridge 272 extends radially inwardly toward a concave annular recess 273 on the outer wall surface of inner flanged ring 107. The inner or smallest radius of ridge 272 is greater than the radius of recess 273 so that ridge 272 fits within recess 273 and the ridge moves freely relative to the inner flanged ring 107 when the subcarrier assembly 230 is in the normal polishing position. However, the ridge 107 and inner flanged ring 107 mechanically interfere with each other and the ridge interferes with and limits the travel of the subcarrier assembly 230 for vertical motions greater than some predetermined excursion about the polishing position.

For example, in one embodiment of the invention, the ridge 272 and recess 273 are sized such that the subcarrier assembly may be moved upward (toward the spindle assembly 120) by about 3 mm, and may be moved downward (toward the polishing surface) by about 3 mm before the ridge stops motion. Of course more or less motion, typically from about 1 mm to about 5 mm could be provide d but is unnecessary for typical polishing and CMP operations. Usually even the ±3 mm travel is only necessary to provide wafer loading and unloading functions, while smaller amounts of movement are typically encountered during actual polishing. When the subcarrier is raised off of the polishing pad surface, the ridge or stop 272 also carries the weight of the subcarrier 230, and to a lesser extent the weight of the less massive retaining ring 250 assembly, so that the diaphragm or other housing to carrier coupling means is not overly extended.

Similarly, the diaphragm 106 is protected from being overly extended in an upward direction by the ridge stop 272.

From the above description of the polishing head, and particularly of the subcarrier assembly, it will be apparent that the subcarrier includes or defines three, independent chambers that can be separately pressurized to different combinations of pressures. These chambers are identified as subcarrier chamber 301, retaining ring chamber 302, and differential chamber 303. Chamber 301 provides a positive or negative subcarrier pressure against the backside of subcarrier 101. Chamber 302 provides a positive or negative retaining ring pressure against retaining ring assembly 250 which is communicated to the ring assembly via primary diaphragm 106. Chamber 303 provides either a positive or negative pressure to retaining ring assembly 250 and subcarrier assembly 230 which is exerted through a central annular region of primary diaphragm 106. It is not ed that the pressure exerted by the third chamber 303 may be interpreted as a differential pressure which modulates the pressure independently asserted against ring assembly 250 and subcarrier assembly 250.

In practice, this differential pressure has a greater effect on the retaining ring and subcarrier immediately proximate to the point of application so that the predominant effect is on the polishing at the edge of the wafer. The application of positive pressure in chamber 303 results in the application of a downward force (force toward the polishing pad) substantially at and immediately adjacent to the interface between the innermost radial portion of the retaining ring 116 and the outermost portion of a wafer attached to the lower surface of the subcarrier 101, so that the polishing characteristic at the edge of the wafer is effected. In practice, the structure and method of applying a pressure in the chamber results in the ability to advantageously reduce the edge exclusion zone from less than about 5 mm to less than 3 mm. The edge exclusion zone or the region where non-uniform polishing or planarization may occur is a radial annular region extending up to about 5 mm inward from the outer edge of the wafer. The edge exclusion region is the annual ring portion at the wafer edge wherein acceptable uniformity is lost. Presently the industry accepted edge exclusion region is as large as about 5 mm and as small as about 3 mm.

We now turn our attention to a description of the operation and functions provided by the structures, particularly to relationships between and among structural elements as the pressure in the chambers are altered. Chamber 301 provides pressure to the main wafer sub-carrier, which to a first approximation (but ignoring the angular movement or tilt of the subcarrier or wafer allowed by the diaphragm suspension) operates to provide pressure to effect the polishing process at the surface 306 of the silicon wafer 305. This silicon wafer surface 306 may be an oxide of silicon, a metal, or the silicon itself, depending on the process and the stage of the process at which it is polished. The silicon wafer surface may be other materials such as silicon nitride that are commonly used in the manufacture of semiconductor devices. When we refer to the silicon wafer or to the wafer, we include any or all of the materials that may be present at that surface and not merely to a pure silicon wafer material. It is important that this sub-carrier be able to move in a substantially friction-free manner and receive uniform or substantially uniform pressure, either pneumatic or hydrodynamic in order to effect a uniform polish across the surface of the wafer. (As described relative to the function of chamber 303, some controlled non-uniformity of pressure applied at the edge of the wafer may correct for non-uniform edge characteristics and actually improve the polishing uniformity.)

Chamber 2 provides independent pneumatic or hydrodynamic pressure to retaining ring 116. This annular ring 116 may be fabricated so as to have a different annular width, that is the outer radial dimension may be modified to tune the polishing head to attain greater uniformity, particularly at the edge of the wafer. The retaining ring material, surface texture, and other characteristics such as dimensions, surface topography, and embedded abrasives may also be selected to achieve desired results. By judicious selection of the retaining ring annular width and retaining ring material, the edge polishing effects may be moved closer to or farther way from the actual edge of the wafer being polished so that the amount of material removed near the edge may be increased or decreased and thereby effect a more uniform region near the edge of the wafer. The positive effect is to reduce the "edge exclusion" region of the wafer from less than about 5 mm to less than about 3 mm. This ring also serves as a retaining ring to hold the wafer in place during the polishing cycle. The down pressure on retaining ring 116 is achieved by applying pressure to chamber 302, independent of the pressure applied in chambers 301 and 303. Flexible primary diaphragm 106 serves to isolate chambers 301 and 302 with minimal resultant friction force in the vertical direction while at the same time providing torque transfer to the wafer 305 itself in the horizontal plane and still permitting angular tilt of the subcarrier to accommodate angular variation between the wafer and the pad. We note that while a polyphenylene sulfide material is used in an exemplary embodiment, other materials including but not limited to ceramic material and other polymers as well as certain other allowable (inert) metals, may be used. Each of the material selected, the annular contact width with the polishing pad, as well as mass and other structural properties of the retaining ring assembly, subcarrier assembly, and the polishing head as a whole may be designed to take into account mechanical resonance frequencies that if not considered may negatively influence polishing uniformity.

The existence and characteristics of chamber 303 provide further innovative feature of the inventive structure, particularly by allowing the application of yet a third pressure, essentially at the edge of the wafer only. The intent and affect of the "differential" or "edge transition chamber" 303 is to provide a slight amount of differential pressure (usually some additional polishing force but the structure supports a lessened polishing force as well) at the very edge of wafer 305 in order to achieve a wafer edge exclusion region of less than about 3 mm, perhaps as small as about 0.5 mm. The third chamber 303 adds considerable flexibility to the polishing process parameters to achieve extreme uniformity of the polished surface of the wafer. Secondary flexible diaphragm 110 serves to isolate the edge transition chamber 303 from chambers 301 and 302 with minimum friction in the vertical direction. Secondary diaphragm 110 also serves to efficiently transfer torque to the wafer subcarrier 101 and hence to wafer 305 during the polishing process. The use of a single flexible diaphragm coupling a retainer ring to a wafer carrier and to a housing is described in U.S. Pat. Nos. 5,205,082; 5,527,209; and 4,918,870, herein incorporated by reference. Dry nitrogen or clean dry air (CDA) is also applied to the hole assembly to serve as a wafer release or ejection process at the end of the polishing, CMP, or other substrate processing procedure. The structure also includes a set of orifices, supplied by a separate supply line that provides means for flushing deionized water (d.i. water) through the holes.

Subcarrier 101 is also constructed to provide the afore described holes 236 at the front side of the wafer subcarrier 101 to allow for vacuum to be applied to the edges of a wafer 305 so that the wafer may be readily picked up during transfer of the wafer to or from other wafer processing apparatus. The vacuum chamber 308 is formed as a channel 309 in the backside of wafer subcarrier 101 and is sealed from other chambers 301, 302, 303 and from the ambient atmosphere through subcarrier gasket 102. The tubes coupling fluid sources including a source of vacuum source 310 via the spindle based rotary union to the fixture 234, channel 309, wafer through holes 236, also is used to communicate deionized water (d.i. water) to flush the back side of the wafer 305*b* at the end of the polish cycle to effectively release the wafer 305 from the carrier 101 and to flush the vacuum holes 236 of any residual polishing slurry or wafer residue that may possibly be present in preparation for receipt and mounting of the next wafer.

Subcarrier 101 optionally, but advantageously, also includes means for flushing de-ionized water or other liquid or fluid through the thin gap between the subcarrier 101 and retaining ring 116 after the polish cycle has completed in order to avoid a slurry buildup in the gap that might otherwise increase friction or cause sticking between the ring 116 and subcarrier 101.

Locking ring 109 serves as a mechanical stop for the main subcarrier assembly 230 to prevent over-extension of the subcarrier or in the event of an applied vacuum to prevent over-retraction of the sub-carrier assembly 230. Lower housing 105 serves as a lower external housing and a mechanical stop for the retaining ring assembly to avoid over-extension of that element. Pressure and vacuum isolation between chambers 301 and 302 is achieved through a double concentric o-rings seal rings 326, 327 disposed between the inner upper housing surface and the housing seal ring 113 that seals against the surface of upper housing 115.

Advantageously, the internal volume of chamber 301 is reduced or minimized in order to shorten the response time required to either apply a vacuum to chamber 301 or to apply a positive pressure to chamber 301. Volume reduction is achieved at least in part by simply not removing material from housing 105, and recessing elements of the retaining ring assembly 250 (for example the outer flanged ring 108, and outer stop ring 112) and subcarrier assembly 230 (for example, inner flanged ring 107, and inner stop ring 111) into a concave region of the upper housing 115, and by extending the thickness other regions of the upper housing 115 to extend closer to subcarrier 101, with the proviso that the housing does not interfere with the other carrier assembly 100 components. Advantageously, the multiple chamber carrier assembly 100 achieves substantial weight savings as compared to conventional structures.

The backside shape of the subcarrier is selected to provide structural strength at minimal weight and to allow for a very slight extra flexibility, actually an ability to distort the stiff structure by very small amounts, at a region near the wafer edge. This slight flexibility at the edge works in conjunction with the edge pressure chamber 3.

An optional extended life wafer subcarrier insert 330 that serves to back wafer 305 during the polishing cycle may optionally be provided. The extended life film is optionally, but desirably, bonded to the subcarrier surface. The material is a polymer chosen for its hardness, surface friction, and wearability. The subcarrier film should be machined or otherwise processed to optical flatness requirements. Importantly, the relatively thick extended life film can be drilled with suitable holes to provide vacuum to the backside or the wafer much more effectively than the films in conventional structures.

The inventive spindle assembly 120 includes a rotary union and was designed in order to supply five independent fluid, gas and pressure/vacuum circuits. The inventive structure provides independently controlled pressure for the central chamber 301, for the retaining ring chamber 302, and for the edge transition chamber 302, as well as vacuum and deionized water. A spindle assembly having a two-port rotary union is described in U.S. Pat. No. 5,443,416, which is hereby incorporated by reference.

These and other feature provide numerous advantages and improvements over the conventional art, including, but not limited to: (1) Multiple, independent pressure chambers. Pressure the subcarrier and wafer, pressure to the retaining ring, pressure to the region between the two. Either positive or negative pressure with respect to the subcarrier. (2) The use of flexible diaphragm, membranes to isolate the chambers, reduce vertical friction and transfer torque to the wafer for polishing. (3) The application of the carrier to silicon polish and planarization of oxide and metal films on silicon multi layer metal circuit structures. (4) The use of vented screws in the assembly to relieve the presence of air in the region of the wafer—either front or back, which causes non-uniformity. (5) The use of the sealing diaphragms as the torque transfer elements. (6) The mechanism for supplying vacuum to the backside of the wafer which doubles as a water flush and nitrogen pressure wafer release mechanism. (7) The use of the extended life insert on the surface of the subcarrier to eliminate the unreliable traditional insert. (8) The capability to use a variety of materials and dimensions for the retaining ring, including a ring designed to include pad conditioning elements. (9) The capability to provide automatic water flush to the region between the sub-carrier and the retaining ring. (10) The two-piece retaining ring mechanism that allows for retaining ring change without disassembly of the entire head (carrier). (11) The use of an accumulator in the vacuum system to allow for ultra-quick response in wafer handling. (12) The capability to use a variety of materials in the fabrication of the subcarrier, from stainless steel through ceramic and polymeric materials to achieve optical flatness, specific surface profiles and surface hardness. (13) The capability to use retaining rings of varying geometries interchangeably without changes to the fundamental mechanisms. Other inventive features are shown in the drawings and recited in one or more of the claims.

The invention also includes the method of polishing and/or planarizing a substrate such as a semiconductor wafer, and the article of manufacture, here the polished or planarized substrate, produced by the by the inventive CMP polishing head and method.

Those workers having ordinary skill in the art in light of the description provided herein will readily appreciate that the inventive polishing head assembly may readily be mounted in a single or multiple carrier polishing machine, and that the inventive three chambered-head though described in the context of a floating subcarrier and floating retaining ring embodiment may also be used with other subcarrier and/or retaining ring structures, though such implementation is not preferred and may be less effective in achieving uniform polishing.

All publications, patents, and patent applications mentioned in this specification are herein incorporated by reference to the same extent as if each individual publication or patent application was specifically and individually indicated to be incorporated by reference.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

What is claimed as:

1. A three-chambered polishing head for polishing a substrate comprising:

a rotatable sub-carrier having a circular shape and an outer diameter for holding said substrate on a substrate mounting surface thereof during a polishing operation;

a rotatable retaining ring having an inner diameter disposed concentric with said sub-carrier and extending beyond said substrate mounting surface during said polishing operation;

a housing at least partially surrounding said sub-carrier and said retaining ring;

a first diaphragm coupling each of said retaining ring said sub-carrier and said housing at a first location while permitting predetermined relative movement between said retaining ring, said sub-carrier, and said housing;

a second diaphragm coupling said retaining ring and said sub-carrier to said housing at a second location while permitting predetermined relative movement between said retaining ring and said sub-carrier;

said sub-carrier, a first portion of said housing, and said first and second diaphragms defining a first pressure chamber;

said sub-carrier, a second portion of said housing, and said first and second diaphragms defining a second pressure chamber;

a member coupling said first diaphragm and said second diaphragm and defining an annular shaped third pressure chamber proximate said sub-carrier outer diameter and said retaining ring inner diameter;

said first chamber, said second chamber, and said third chamber being pressure isolated from each other and each being coupled to a pressurized fluid source so that the pressure in each of said first, second, and third chambers is separately controllable.

2. The polishing head in claim 1, wherein said substrate is a semiconductor wafer.

3. The polishing head in claim 1, wherein separate control is accomplished with first, second, and third control values between a source of pressurized fluid and a respective chamber.

4. The polishing head in claim 3, wherein said pressurized fluid is a pressurized gas.

5. A polishing head for polishing a substrate comprising:

a subcarrier having a circular shape and an outer diameter for holding said substrate during processing;

a retainer ring having a circular shape and an inner diameter disposed concentric with said subcarrier;

an annular region being defined as a predetermined distance on either side of an interface between said subcarrier and said retaining ring;

a first chamber disposed proximate said subcarrier to apply a first pressure to said subcarrier and hence to said substrate against a polishing pad during polishing;

a second chamber disposed proximate said retaining ring to apply a second pressure to said retaining ring against said polishing pad during said polishing;

a third chamber disposed proximate said annular region to apply a third pressure to said region proximate the interface between said retaining ring and said subcarrier to influence the polishing of an annular peripheral region of said substrate.

6. The polishing head in claim 5, wherein said substrate is a semiconductor wafer.

7. The polishing head in claim 5, wherein separate control is accomplished with first, second, and third control values between a source of pressurized fluid and a respective chamber.

8. The polishing head in claim 7, wherein said pressurized fluid is a pressurized gas.

9. In a semiconductor wafer polishing machine, a method of controlling the polishing pressure over annular regions of the wafer, said method comprising steps of:

controlling a first pressure exerted on the wafer against a polishing pad to affect the material removed from the wafer;

controlling a second pressure exerted on a retaining ring, disposed concentric with the wafer, directly against the polishing pad, to affect the manner in which the polishing pad contacts the wafer at a peripheral edge of the wafer; and controlling a third pressure exerted within a predetermined annular region proximate an inner annular region of said retaining ring and an outer annular edge of said wafer to affect a change to said first and second pressure only proximate said annular region;

each of said first, second, and third pressures being independently controllable of the other pressures.

* * * * *